United States Patent [19]

Akazawa et al.

[11] Patent Number: 4,706,470

[45] Date of Patent: Nov. 17, 1987

[54] SYSTEM FOR CONTROLLING COMPRESSOR OPERATION

[75] Inventors: Naoki Akazawa, Ohta; Kazuhiko Nishi, Gunma; Naoya Kawakami, Ohta; Yoshiaki Fujisawa, Kumagaya; Noriyoshi Yamada, Nitta, all of Japan

[73] Assignee: Sawafuji Electric Co., Ltd., Japan

[21] Appl. No.: 863,129

[22] Filed: May 14, 1986

[30] Foreign Application Priority Data

| | | | |
|---|---|---|---|
| May 16, 1985 | [JP] | Japan | 60-104387 |
| May 16, 1985 | [JP] | Japan | 60-104388 |
| Oct. 31, 1985 | [JP] | Japan | 60-244451 |
| Oct. 31, 1985 | [JP] | Japan | 60-244452 |
| Oct. 31, 1985 | [JP] | Japan | 60-244453 |
| Oct. 31, 1985 | [JP] | Japan | 60-244454 |
| Oct. 31, 1985 | [JP] | Japan | 60-244455 |
| Oct. 31, 1985 | [JP] | Japan | 60-244456 |
| Oct. 31, 1985 | [JP] | Japan | 60-244457 |
| Oct. 31, 1985 | [JP] | Japan | 60-244459 |

[51] Int. Cl.[4] ..... F04B 17/04; F25B 1/00

[52] U.S. Cl. ..... 62/209; 62/228.3; 417/417

[58] Field of Search ..... 62/228.4, 228.3, 209; 417/19, 44, 417

[56] References Cited

U.S. PATENT DOCUMENTS

| | | | |
|---|---|---|---|
| 4,027,211 | 5/1977 | Omura et al. | 318/127 |
| 4,283,920 | 8/1981 | Kainuma et al. | 62/126 |
| 4,320,448 | 3/1982 | Okuda et al. | 363/134 |
| 4,416,594 | 11/1983 | Ichikawa | 417/417 X |
| 4,474,537 | 10/1984 | Dölz | 417/44 |
| 4,514,991 | 5/1985 | Zinsmeyer | 62/228.4 |

*Primary Examiner*—William E. Wayner

*Attorney, Agent, or Firm*—McGlew and Tuttle

[57] ABSTRACT

A system and apparatus for controlling the operation of a vibrating compressor using a predetermined frequency corresponding to the load thereof, comprising a first sensor for detecting a temperature of pressure corresponding to the saturated vapor pressure of a refrigerant sucked by a vibrating compressor, a second sensor for detecting a temperature or pressure corresponding to the saturated vapor pressure of the refrigerant compressed and discharged by the compressor, and a control section for generating a drive power of a predetermined frequency based on the temperatures and pressures detected by the first and second sensors, and characterized in that the compressor is driven by a drive power generated by the control section. In the present invention, the operation of the vibrating compressor can be controlled at the maximum efficiency by relating the frequency of an alternating current power fed to the vibrating compressor with the suction temperature or pressure and the discharge temperature of pressure of the refrigerant.

23 Claims, 21 Drawing Figures

SYSTEM FOR CONTROLLING COMPRESSOR OPERATION

BACKGROUND OF THE INVENTION

1. Field of the Invention

This invention relates generally to a system for controlling the operation of compressors, and more specifically to a system for controlling the operation of a vibrating compressor at the maximum efficiency with a simple configuration by relating the frequency of an alternating current electric power fed to the vibrating compressor with the temperatures or pressures of a refrigerant sucked and discharged by the compressor.

2. Description of the Prior Art

Heretofore, a refrigerator where refrigeration is effected by using a vibrating compressor to compress a refrigerant gas into a liquid form and causing the liquefied refrigerant gas to evaporate to use the vaporization heat for refrigeration is known. The vibrating compressor used for this purpose is usually divided into the following types; a type using ferrite magnets for maintaining high coersive force, a type using alnico magnets for maintaining high residual magnetic flux density, and type using a combination of ferrite and alnico magnets to take advantage of the benefits of both for improving the magnetic properties of the compressor as a whole.

FIG. 1 shows the construction of the third type of vibrating compressor, which is controlled with the system embodying this invention. In the following, the construction and operation of this type of vibrating compressor.

In a vibrating compressor 500 shown in the figure, a compressor proper 3 is resiliently supported by springs 4 and 5 in an enclosed cylindrical container 2 comprising a cylinder 2*a* and cover plates 2*b* and 2*c* for closing both open ends of the cylinder 2*a*. A casing 6 of the compressor proper 3 consists of a yoke 7 and a closing member 8. One end of the yoke has such a construction that one end, that is, the upper end of the cylinder 7*a* is closed with a bottom piece 7*b*. At the other end of the yoke 7, that is, the lower end of the cylinder 7*a*, the closing member 8 is installed at the time of assembly. In the casing 6 consisting of the yoke 7 and the closing member 8 provided are two types of permanent magnets; i.e., an alnico magnet and a ferrite magnet, which are disposed at different location, as shown in FIG. 1. The alnico magnet is adapted to be magnetized in the axial direction of the compressor, and the ferrite magnet in the radial direction of the compressor. The length of the alnico magnet in the axial direction of the compressor is adapted to be longer than the axial length of a pole piece 13 formed on an internal iron core 40 so as to ensure uniform magnetic flux in an annular magnetic gap 14. A magnetic path is formed with respect to the permanent magnets 11 and 12 by the cylinder 7*a*, the bottom piece 7*b*, the internal iron core 40, and the cylindrical pole piece 13. Within a magnetic gap 14 formed by the cylinder 7*a*, the bottom piece 7*b* and the internal iron core 40, disposed is an electromagnetic coil, that is, a drive coil 16, which is vibratably supported by a mechanical vibrating system via resonating springs 20 and 21. A piston 18 is integrally connected to the drive coil 16 via a coil supporting member 17.

An example of the system for controlling the operation of a vibrating compressor noted at the beginning of this Specification is shown in FIG. 2. In FIG. 2, a vibrating compressor 500 is controlled so as to operate in a resonating state, i.e., at the maximum frequency, as a drive power V is applied alternately to the primary windings having different polarities of a transformer 400 by alternately bringing switching transistors $TR_1$ and $TR_2$ into conduction. To achieve this, the switching transistor $TR_1$ and $TR_2$ are alternately switched into a conducting or non-conducting state in such a fashion as shown by a current waveform in FIG. 3, and the switching frequency is controlled so as to coincide with the resonance frequency of the vibrating compressor 500. More specifically, a base current "$I_B$" is alternately fed from a drive power source 2000 shown in FIG. 2 to the bases of the switching transistors $TR_1$ and $TR_2$ so that a collector current "$I_C$" shown in FIG. 3 can be switched. That is, a drive power having a desired frequency is obtained as the switching transistors $TR_1$ and $TR_2$ are alternately switched into a conducting or non-conducting state by feeding the base current "$I_B$" having a trapezoidal waveform, as shown by (1) through (3) in the figure, as a current waveform obtained by multiplying "$I_B$" by a current amplification factor "$h_{FE}$" so as to satisfy the condition:

$$I_C \geqq h_{FE} \times I_B$$

at points $P_1$ through $P_3$ in the figure. As described above, the conventional type of vibrating compressor 500 has heretofore been operated using a drive power having a frequency coinciding with the resonance frequency of the compressor 500.

In the conventional control method, where the current of the vibrating compressor 500 is controlled so that the switching transistors are switched into a conducting or nonconducting state under the condition $I_C \leqq h_{FE} \times I_B$, the following problems are encountered. Firstly, the signals required for setting the timing for switching the switching transistors into a conducting or non-conducting state are subject to the adverse effects of ripples, leading to fluctuations in the timing of switching. Secondly, since the timing for bringing a switching transistor into a nonconducting state, as shown in FIG. 3, tends to be changed by the current amplification factor "$h_{FE}$" for the transistor, the values of the current amplification factor for both the transistors must be agreed with each other. Furthermore, there is another problem of the difficulty in operating the vibrating compressor 500 always at the maximum efficiency due to fluctuation in the current amplification factor "$h_{FE}$" due to temperature changes and to secular changes, etc.

To overcome these problems, a system has been conceived, in which the pressures of a refrigerant sucked and discharged by the vibrating compressor 500 are detected, and the frequency of the drive power fed to the vibrating compressor 500 is controlled based on the detected pressures of the refrigerant. This system, however, seems to involve the need for installing the pressure sensors detecting the suction and discharge pressures of the refrigerant on the compressor 500 in a sealed state, leading to complicated construction and increased costs.

FIG. 4 shows a surge voltage suppression circuit of a conventional type used for a car-board refrigerator, which operate a vibrating compressor 500 using a drive power having a frequency coinciding with the resonance frequency of the compressor 500. This circuit has such a circuit configuration as shown in FIG. 4, for protecting the switching transistors $TR_1$ and $TR_2$ from surge voltages due to electromagnetic induction in the transformer caused by the alternating actions, i.e., the on-off operation of the switching transistors $TR_1$ and $TR_2$. That is, surge voltage absorbing elements, bidirectional varistors 77 and 78, for example, are provided in parallel each across the collector and emitter of each of switching transistors $TR_1$ and $TR_2$, which are controlled by outputs Q and $\overline{Q}$ of a predetermined frequency generated from a drive power generator 2000, and a bidirectional varistor is provided across both ends of a d-c input power source, as shown in FIG. 4. The surge voltage appearing on both ends of the d-c input power source, for example, is absorbed by the varistor 72. Among the surge voltages induced by the electromagnetic induction generated in a transformer 400 by the action of the switching transistors $TR_1$ and $TR_2$, the surge voltage induced in the winding 401 of the transformer 400 by the on-off action of the transistor $TR_1$ is absorbed by the varistor 77 connected in parallel across the collector and emitter of the transistor $TR_1$, and the surge voltage induced in the winding 402 of the transformer 400 by the on-off action of the transistor $TR_2$ is absorbed by the varistor 78 connected in parallel across the collector and emitter of the transistor $TR_2$. In this way, the surge voltage absorbing circuit protects the transistors $TR_1$ and $TR_2$ from surge voltages. In addition, as the measure for protecting against excess currents flowing in the transistors $TR_1$ and $TR_2$, an overcurrent detecting circuit 74 is provided to detect excess currents to interrupt the outputs Q and $\overline{Q}$ from the drive power generator 2000. In the figure, numerals 75 and 76 denote diodes, but description on these diodes has been omitted here because they are not directly related to this invention. The windings 401 and 402 of the transformer 400 are wound on the same iron core of the transformer 400.

In the surge voltage absorbing circuit for the conventional type of car-board refrigerators shown in FIG. 4, varistors as surge voltage absorbing elements are provided for each switching transistor. It is desired therefore to reduce the number of parts by protecting two switching transistors from surge voltages with a single varistor.

SUMMARY OF THE INVENTION

It is therefore an object of this invention to provide a system for controlling the operation of a vibrating compressor in which the compressor is operated at the maximum efficiency by adopting a simple construction which detects the pressure of refrigerant sucked by the compressor, or grasping the pressure based on the temperature of the refrigerant, and detects the pressure of refrigerant compressed and discharged by the compressor, or grasping the pressure based on the temperature of the refrigerant to operate the compressor using a drive power having a frequency corresponding to at least the pressure or temperature thus detected or grasped.

It is another object of this invention to provide a system for controlling the operation of a vibrating compressor which has a circuit device for preventing the malfunction of the control section even at low frequencies, like commercial frequencies, having such a configuration using a low-speed operating comparator ahead of a high-speed operating, switching control circuit IC to substitute a steep output from the comparator for a phase-controlling voltage to the high-speed operating, switching circuit IC.

It is a further object of this invention to provide a system for controlling the operation of a vibrating compressor having a d-c power source for car-board refrigerators, which has such a construction that when the voltage of a battery feeding a d-c power to the control section lowers below a predetermined level, the supply of the d-c power to the control section is interrupted via a d-c power supply and interruption circuit system, based on battery monitoring signals output from a battery monitoring device.

It is a further object of this invention to provide a system for controlling the operation of a vibrating compressor for car-board refrigerators having a surge voltage suppression circuit which prevents switching transistors from being destructed by connecting surge voltage suppressing elements at effective locations to absorb surge voltages induced in a transformer by the alternately operating switching transistors, and reduces the number of parts.

DESCRIPTION OF THE PREFERRED EMBODIMENTS

Figure 5:
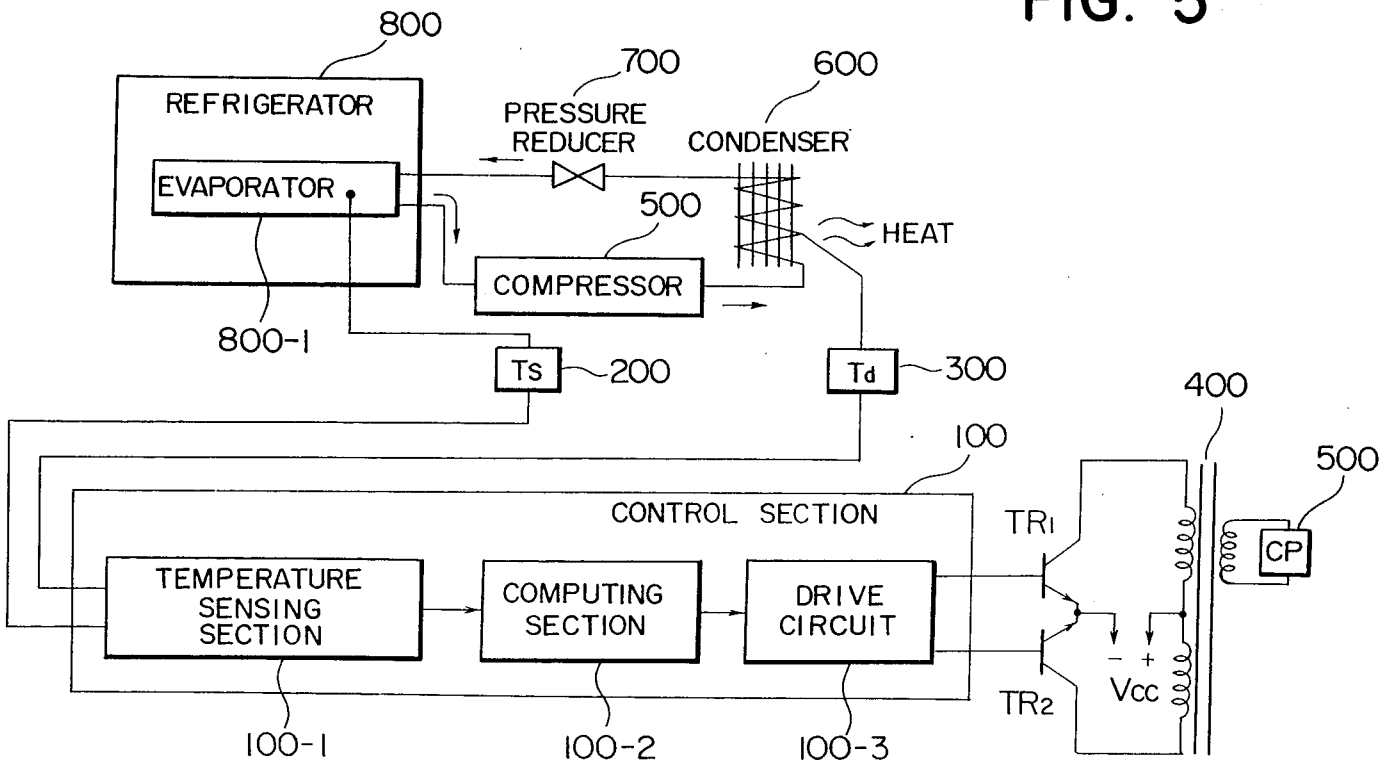
FIG. 5 is a diagram illustrating a system for controlling the operation of a vibrating compressor, embodying this invention.

FIG. 5 shows an embodiment of this invention in which control is effected by grasping the pressure of refrigerant sucked or discharged by the vibrating compressor based on the temperature of the refrigerant.

In FIG. 5, a control section 100 consists of a temperature sensing section 100-1, a computing section 100-2 and a drive circuit 100-3, and is used for supplying drive signals having such a frequency that the compressor 500 is operated in a resonating state based on each of the signals from a temperature sensor ($T_s$) 200 for detecting the temperature corresponding to the saturated vapor pressure of the refrigerant sucked by the compressor 500 and from a temperature sensor ($T_d$) 300 for detecting the temperature corresponding to the saturated vapor pressure of the refrigerant compressed and discharged by the compressor 500. The temperatures detected by the temperature sensing section 100-1 can be regarded as the temperatures corresponding to the pressure of the refrigerant on the suction side and the pressure of the refrigerant on the discharge side.

The vibrating compressor 500 receiving the drive power generated by the drive signals fed by the control section 100 compresses the refrigerant into a mixture of the gaseous and liquid refrigerant, which is in turn fed to a condenser 600 to cause the mixture to release heat for liquefaction. The liquefied refrigerant is fed via a pressure reducer 700 to an evaporator 800-1 provided in the refrigerator 800 where the refrigerant is evaporated to refrigerate the inside of the refrigerator 800. The refrigerant taking the heat of evaporation is compressed again in the compressor 500. By repeating the aforementioned closed cycle, the heat taken away from the evaporator 800-1 is released in the form of heat from the condenser 600. In the following, the operation of the control section 100 will be described.

In the figure, the computing section 100-2 is used for generating a voltage corresponding to a frequency at which the compressor 500 operates in a resonating state, based on the "temperature corresponding to the suction pressure" and the "temperature corresponding to the discharge pressure," both converted into electrical signals by the temperature sensing section 100-1.

The drive circuit 100-3 is used for supplying electric current from the d-c power source $V_{cc}$, as shown in the figure, to the primary windings of the transformer 400 in a square waveform and in an alternately switching fashion with respect to the windings having different polarities by feeding to the transistors $TR_1$ and $TR_2$, as shown in the figure, a drive signal having a frequency corresponding to the voltage fed from the computing section 100-2. As the a-c voltage appearing on the secondary windings of the transformer 400 is fed to the compressor 500, the compressor 500 is operated at all times in a resonating state, that is, at the maximum efficiency.

In the following, how the operation of the compressor 500 is controlled in a resonating state will be described in detail, referring to FIG. 6.

Figure 6:
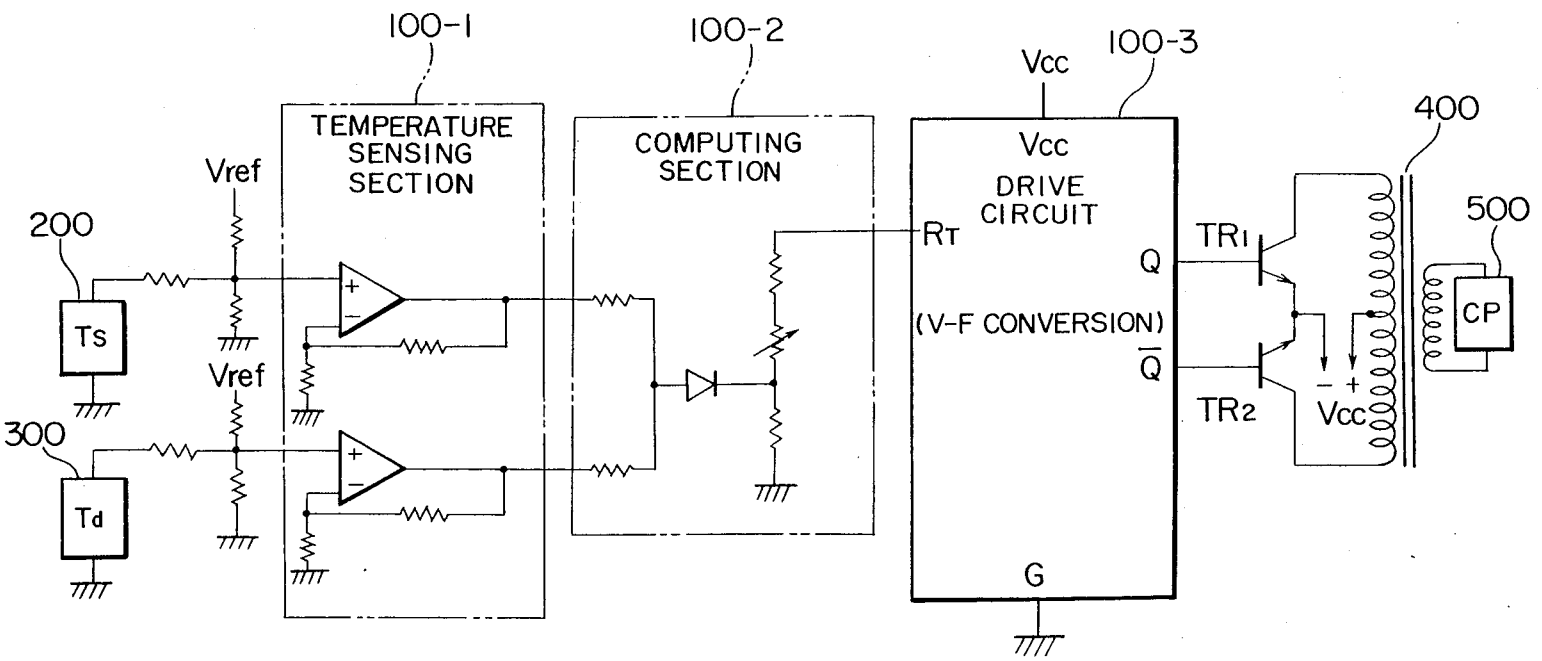
FIG. 6 is a diagram illustrating the construction of the essential parts of the embodiment shown in FIG. 5.

In FIG. 6, the temperature sensors 200 and 300, the temperature sensing section 100-1, the computing section 100-2, the drive circuit 100-3, the transformer 400 and the compressor 500 are of the same type as shown in FIG. 5.

First, the resonance frequency of the vibrating compressor 500 can be expressed by the following equation.

$$f=A(K/M)^{\frac{1}{2}} \quad (1)$$

where A represents a constant, M the mass of a piston comprising the compressor 500, and K a spring constant, respectively. The spring constant K can be expressed by the following equation.

$$K=K_1\times 2+2+K_{ps}+K_{pd} \quad (2)$$

where $K_1$ represents the spring constant of each of the springs supporting the piston comprising the compressor 500 from both sides, $K_{ps}$ a constant determined by the refrigerant sucked by the compressor 500, and $K_{pd}$ a constant determined by the refrigerant discharged by the compressor 500.

As evident from the equations (1) and (2) above, the resonance frequency of the compressor 500 increases as the suction pressure of the refrigerant sucked by the compressor 500 and the discharge pressure of the refrigerant compressed and discharged by the compressor 500 increase. Consequently, by controlling the frequency of the drive power fed to the compressor 500 in such a fashion as to relate to "suction pressure calculated from the temperature" of the refrigerant sucked by the compressor 500 and the "discharge pressure calculated from the temperature" of the refrigerant compressed and discharged by the compressor 500, it is made possible to operate the compressor 500 at the resonating frequency thereof, that is, at the maximum efficiency, without being affected by the load of the compressor 500, as is realized by the present invention.

Next, the operation of the circuit configuration shown in FIG. 6 will be described in the following.

In the figure, the signal of the temperature ($T_s$) of the refrigerant sucked by the compressor 500 and detected by the temperature sensor 200 and the signal of the temperature ($T_d$) of the refrigerant discharged by the compressor and detected by the temperature sensor 300 are fed to the positive terminal of the respective operational amplifiers in the temperature sensing section 100-1 where the signals are amplified to a predetermined level. The signals thus amplified are calculated to obtain the "$K_{ps}+K_{pd}$" value in the equation (2) by the resistance circuit network in the computing section 100-2, as shown in the figure. The signals thus calculated are fed to the drive circuit 100-3 where the signals are converted, in terms of voltage and frequency, into square-wave signals having frequencies corresponding to the signals. The square-wave signals that have been converted in terms of voltage and frequency are fed to $TR_1$ and $TR_2$ in the figure, electric currents whose polarities vary alternately are fed from the d-c power source $V_{cc}$ to the primary windings of the transformer 400. Then, an a-c voltage obtained from the secondary windings of the transformer 400 is fed to the compressor 500. Thus, it is made possible to control the frequency of the drive power for driving the compressor 500 at the maximum efficiency, that is, in a resonating state at all times while relating to the pressure of the refrigerant sucked by the compressor 500 and the pressure of the refrigerant compressed and discharged by the compressor 500.

Figure 7:
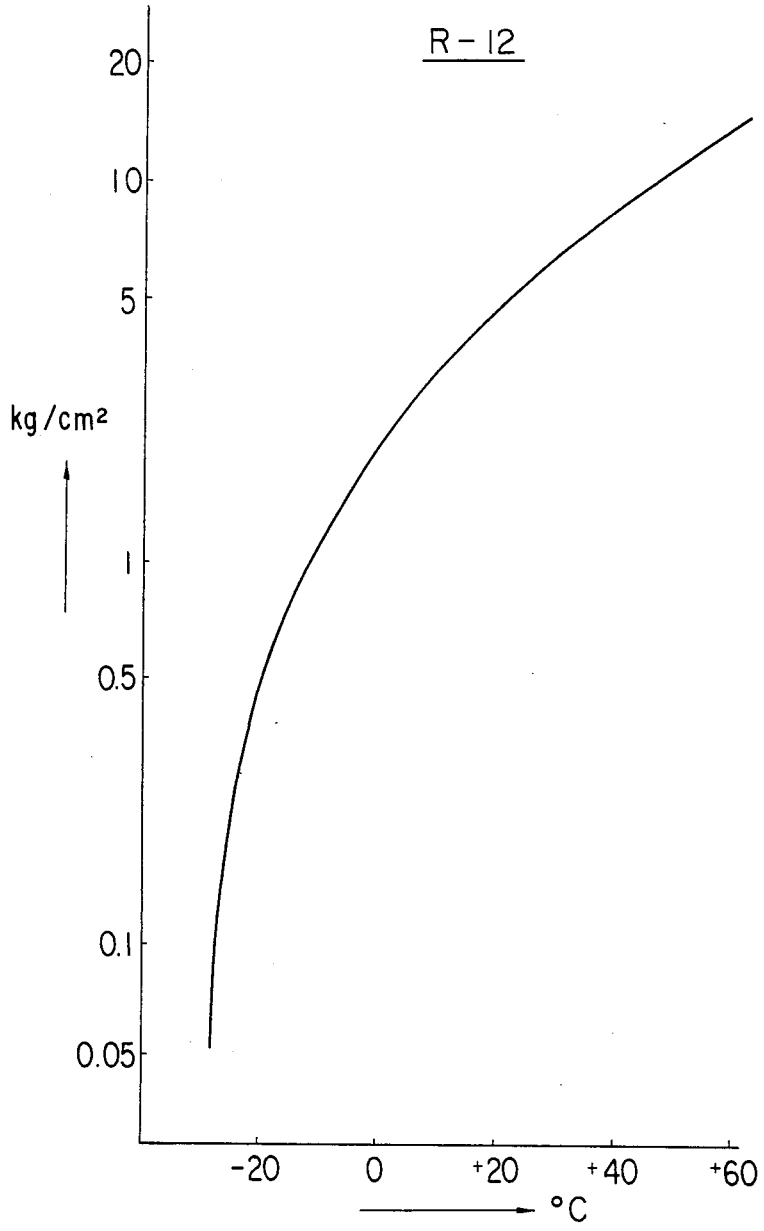
FIG. 7 is a diagram illustrating the conversion characteristics of converting refrigerant temperature into pressure.

FIG. 7 is a temperature-pressure conversion characteristic diagram for the conversion of the refrigerant temperature into pressure, more particularly, that for "Fron 12 (R-12)" as a refrigerant. In the figure, the abscissa represents the temperature "°C." and the ordinate the pressure per unit area "kg/cm$^2$". By using the temperature-pressure conversion characteristic diagram shown in FIG. 7, the pressure of refrigerant can be calculated from the temperature value detected by the temperature sensors 200 and 300 shown in FIGS. 5 and 6. As the temperature sensors 200 and 300, commercially available low-cost and easy-to-install thermistors, thermocouples and other devices can be used.

As described above, this invention makes it possible to control the operation of a vibrating compressor at the maximum efficiency with a simple construction using inexpensive temperature-sensing elements by feeding to the compressor a drive power having a predetermined frequency generated on the basis of the temperature corresponding to the saturated vapor pressure of the refrigerant sucked by the compressor and the temperature corresponding to the saturated vapor pressure of the refrigerant compressed and discharged by the compressor.

Figure 8:
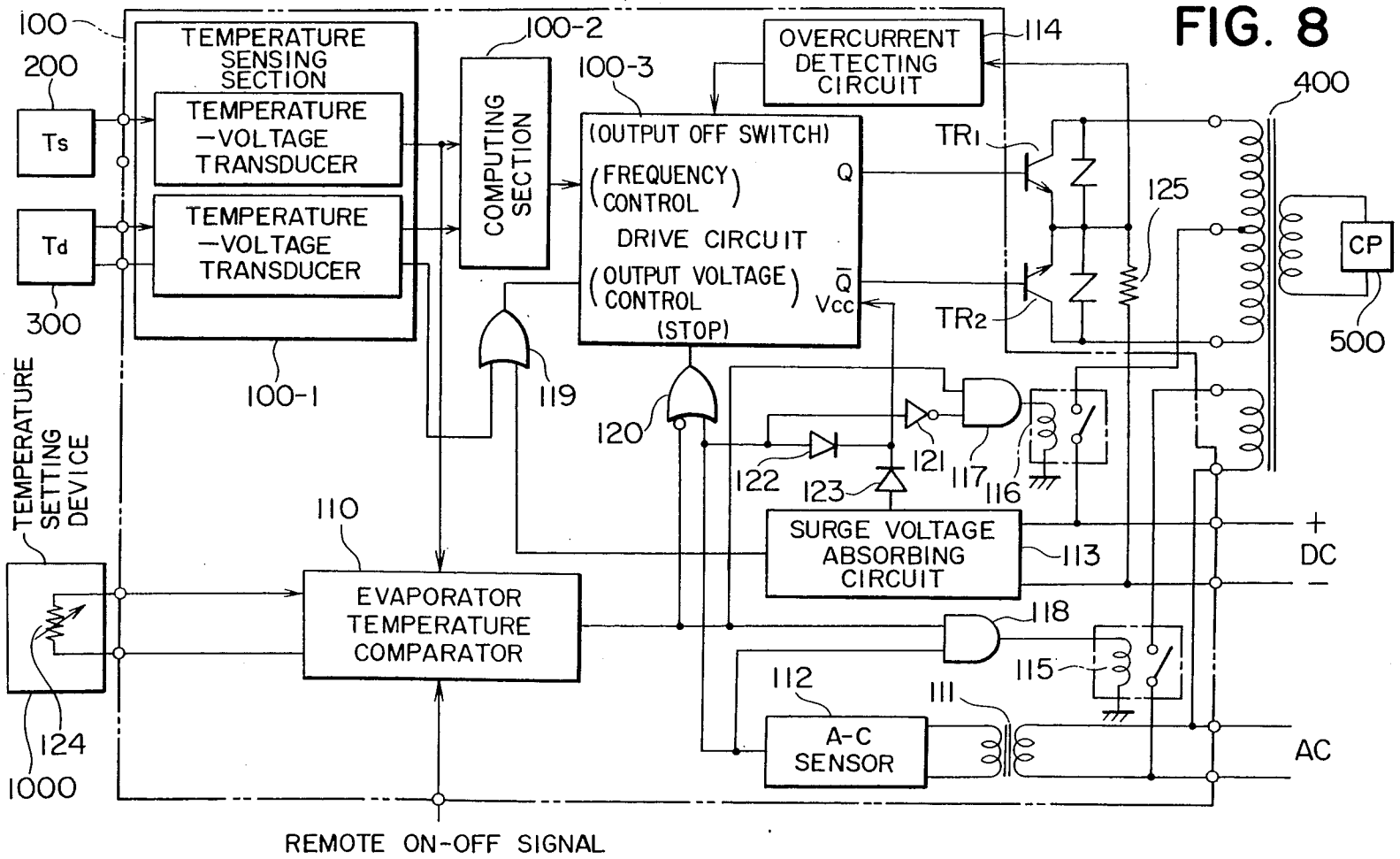
FIG. 8 is a diagram illustrating the details of an example of the apparatus for controlling the operation of car-board refrigerators to which this invention is applied.

FIG. 8 shows the detailed construction of an example of the control section for a vibrating compressor for car-board refrigerators to which this invention is applied. In the figure, reference numerals 100-1, 100-2, 100-3, 200 and 300, symbols $TR_1$ and $TR_2$ represent like parts as shown in FIG. 5 or FIG. 6. Description of these parts has therefore been omitted here. Reference numeral 1000 refers to a temperature setting device; 110 to an evaporator temperature comparator; 111 to a transformer; 112 to an a-c sensor; 113 to a surge absorbing circuit; 114 to an overcurrent sensing circuit; 115 and 116 to relays; 117 and 118 to AND circuits; 119 and 120 to OR circuits; 121 to an inverter; 122 and 123 to diodes; 124 to a variable resistor; and 125 to a shunt, respectively.

The temperature setting device 1000 is used for setting the inside temperature of the refrigerator and capable of changing the inside temperature setting by the variable resistor 124 provided in the temperature setting device.

The evaporator temperature comparator 110 electrically compares a signal for the inside temperature of the refrigerator set by the variable resistor 124 and a signal from the temperature sensor 200 for detecting the temperature of the evaporator 800-1, and outputs a logic "L" when the temperature on the side of the evaporator 800-1 becomes higher than the temperature setting on the temperature setting device 1000. The logic "L" output acts as a stop signal for the drive circuit 100-3 via the OR circuit 120 having a NOT input terminal, opening the contacts of the relay 116 via the AND circuit 117 to interrupt the supply of d-c power to the transistor $TR_1$ and $TR_2$.

The transformer 111 is used, when a commercial power supply is connected to the car-board refrigerator, for decreasing the voltage of the commercial power to feed to the a-c sensor 112 connected to the secondary winding of the transformer 111, in which the commercial power is detected.

The a-c sensor 112 is used for detecting whether or not a commercial power is input. When a commercial power is input, the a-c sensor 112 produces a logic "H", which acts as a stop signal for the drive circuit 100-3 via the OR circuit 120, opening the contacts of the relay 116 to interrupt the supply of d-c power to the transistors $TR_1$ and $TR_2$. The a-c sensor 112 also closes the contacts of the relay 115 via the AND circuit 118 to supply a-c power to the transformer 400 via the relay 115.

The surge voltage absorbing circuit 113 supplies a d-c power to the drive circuit 100-3 after absorbing surge voltages in the d-c power being input, and produces a logic "H" when the voltage of the d-c power being input is higher than a predetermined level. The logic "H" causes the drive circuit 100-3 to control the output of the transistors $TR_1$ and $TR_2$ via the OR circuit 119 to control the stroke of the compressor 500.

The overcurrent sensing circuit 114 is used for detecting, together with the shunt 125, an excess current flowing in the transistors $TR_1$ and $TR_2$. The overcurrent sensing circuit 114, when detecting an excess current, outputs to the drive circuit 100-3 an output off-latch signal that stops the operation of the transistors $TR_1$ and $TR_2$ to prevent the transistors $TR_1$ and $TR_2$ from being damaged.

Next, this invention will be described in detail, referring to FIGS. 9 and 10.

Figure 9:
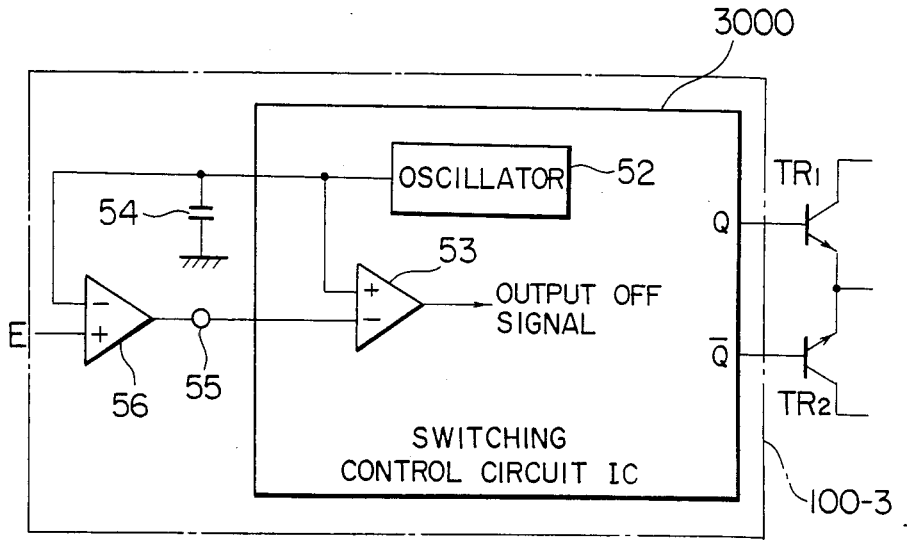
FIG. 9 illustrates the peripheral circuits of a drive circuit according to this invention.

In FIG. 9, numeral 3000 refers to a switching control circuit IC; 52 to an oscillator; 53 to a comparator; 54 to a capacitor; 55 to a terminal; 56 to a low-speed operating comparator and symbols $TR_1$ and $TR_2$ to transistors. The negative input terminal of the low-speed operating comparator 56 is connected to a capacitor 54 on which a triangular-wave voltage appears, and a phase-controlling voltage E is applied to the positive input terminal of the comparator 56. The output of the comparator 56 is connected to the terminal 55.

Needless to say, the switching control circuit IC 3000, the capacitor 54 and the comparator 56 constitute part of the drive circuit shown in FIG. 8.

As the square-wave voltage oscillated at a commercial frequency by the oscillator 52 charges the capacitor 54, a triangular-wave voltage of the commercial frequency appears on the capacitor 54. That is, the triangular wave voltage of the commercial frequency is applied to the netative input terminal of the comparator 56 as well. On the other hand, a phase-controlling voltage E, based on which the duty of the output waveform is determined, is applied to the positive input terminal of the comparator 56. Consequently, at the point of time $T_1$ when the triangular-wave voltage input to the negative input terminal of the comparator 56 becomes higher than the phase-controlling voltage E applied to the positive input terminal, the output of the comparator 56 is reversed from "H" to "L". And, at the point of time $T_2$ when the charged voltage of the capacitor 54 becomes zero, the output of the comparator 56 is reversed again from "L" to "H". Furthermore, the output of the comparator 56 is reversed from "H" to "L" at the point of time $T_3$ of the next cycle when the triangular-wave voltage becomes higher than the phase-controlling voltage E. In this way, during the periods $T_0$–$T_1$, $T_2$–$T_3$, and $T_4$–$T_5$ when the triangular-wave charged in the capacitor 54 remains lower than the phase-controlling voltage E, the output of the comparator 56 is kept at "L". Conversely, during the periods $T_1$–$T_2$, $T_3$–$T_4$, and $T_5$–$T_6$ when the triangular-wave voltage charged in the capacitor remains higher than the phase-controlling voltage E, the output of the comparator 56 is kept at "H". In other words, the output of the comparator 56 changes abruptly from "H" to "L" at the points of time $T_1$, $T_3$ and $T_5$.

Figure 10:
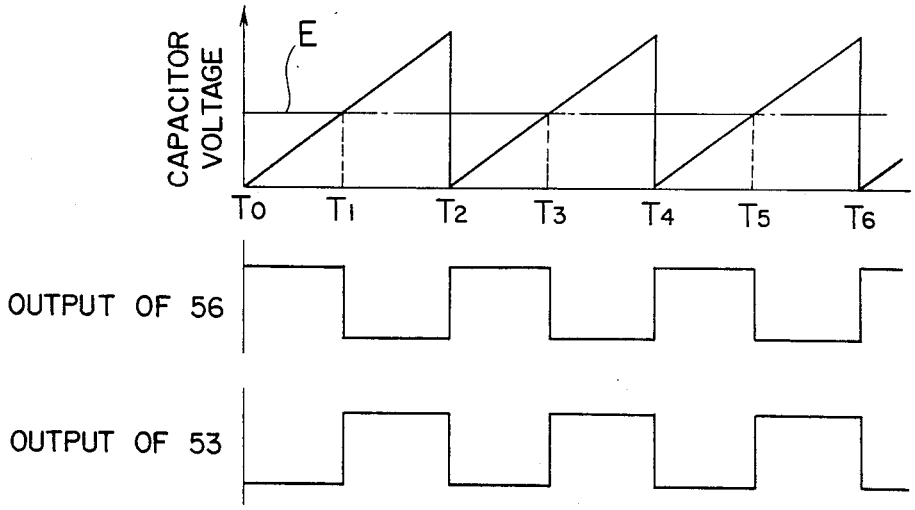
FIG. 10 is a working waveform diagram of assistance in explaining the operation of the circuits shown in FIG. 9.

The output of the comparator 53 becomes as shown in FIG. 10 since the output voltage of the comparator 56 is compared with the triangular-wave voltage charged in the capacitor 54, and the voltage input to the negative input terminal of the comparator 53 changes sharply from "H" to "L" at the points of time $T_1$, $T_3$ and $T_5$. This makes it difficult to cause malfunctions at the rise time of the output of the comparator 53.

Since the comparator 56 is of a low-operating type, the output of the comparator 56 is hardly affected by the noises superposed on the phase-controlling voltage E input fed to the positive input terminal of the comparator 56.

In the car-board refrigerator of a type using a drive power having the same frequency as the resonance frequency of the vibrating compressor thereof, a fuse or circuit breaker has heretofore been used in the mains circuit to cut off the mains circuit, whereby protecting the car-board refrigerator from excess current.

When a fuse or circuit breaker is used as an overcurrent protector to cut off the mains circuit, an excess current might occur in a failure of the mechanical system, such as the compressor, due to the slow response time of such an overcurrent protector. This might lead to a breakdown of the drive power source for driving the compressor, necessitating the replacement not only of the failed mechanical system but also of the control section of the electrical system. An overcurrent protector using a fuse or circuit breaker involves the replacement or resetting the component once it has been used for the purpose. This makes it necessary to take account of the location of installation of the fuse or circuit breaker to facilitate its replacement or resetting, leading to the complicated wiring of the mains circuit.

This invention uses a quick-response electronic circuit, which instantly interrupts the oscillation of the control section supplying power to the vibrating compressor when an excess current flows, and can also use a fuse or circuit breaker as double protection without the need for taking account of the location of installation thereof.

In the following, this invention will be described in further detail, referring to FIG. 11.

Figure 11:
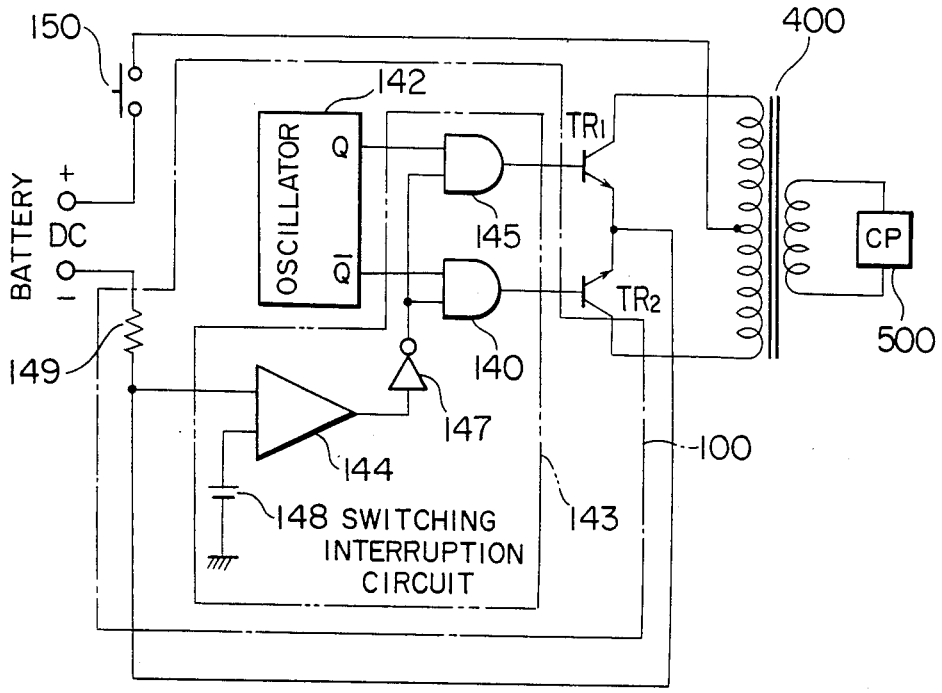
FIG. 11 shows an example where the control section according to this invention has an excess current protection function.

In FIG. 11, numerals 400 and 500, symbols $TR_1$ and $TR_2$ represent like parts as shown in FIG. 5. Numeral 142 refers to an oscillator; 143 refers to a switching interruption circuit; 144 refers to a comparator; 145 and 146 to AND circuits; 147 to an inverter; 148 to a reference power supply; 149 to a shunt resistor; and 150 to a circuit breaker, respectively.

The oscillator 142 corresponds to the oscillator 52 shown in FIG. 9. The switching interruption circuit 143 is connected between the outputs Q and $\overline{Q}$ of the oscillator 142 and the switching transistors $TR_1$ and $TR_2$. The switching interruption circuit 143 is composed of the comparator 144 for comparing the voltage of the reference power supply 148 with the voltage appearing across the shunt resistor 149 as a current sensing element, the inverter 147 and the AND circuits 145 and 146.

Now, assume that the current flowing in the transistor $TR_1$ or $TR_2$ is increased for some reason or other. Then, the voltage appearing across the shunt resistor 149 increases to a level higher than the voltage of the reference power supply 148. When the voltage appearing across the shunt resistor 149 becomes higher than the voltage of the reference power supply 148, the comparator 144 outputs a logic "H" as a stop signal. The logic "H" as a stop signal is reversed by the inverter 147, and a logic "L" is input to the AND circuits 145 and 146. Consequently, both the AND circuits 145 and 146 have a logic "L" as the outputs thereof, interrupting the operation of the switching transistors $TR_1$ and $TR_2$. This interrupts the supply of drive power to the compressor 500, stopping the compressor 500.

A current transformer may be used as a current sensing element in place of the shunt resistor 149. Needless to say, a current transformer, if used as a current sensing element, should have such a construction that the voltage appearing on the secondary side of the current transformer is compared with the voltage of the reference power supply 148.

Similarly, a fuse may be used as a current sensing element in place of the shunt resistor 149, using the resistance component thereof as a sensing element, and the voltage across the fuse is compared with the voltage of the reference power supply 148. In this case, when the current flowing in the fuse increases, the resistance value thereof increases with the temperature rise, increasing the voltage across the fuse, thus facilitating the detection of an excess current. The use of a fuse has an advantage that the circuit breaker 150 may be eliminated because the fuse blows out even when the switching interruption circuit 143 fails to operate for some reason or other.

In the aforementioned car-board refrigerators using a vibrating compressor, which is driven by a drive power having the same frequency as the resonance frequency of the compressor, a temperature sensing element for sensing a temperature around the condenser is usually provided in the condenser thereof as a compressor protection device for protecting the compressor from being unwantedly operated in an extremely low temperature atmosphere.

Eyeing at the fact that the drive power for driving a vibrating compressor usually employs a temperature feedback system, with a temperature sensing element equipped in the condenser, as noted above, this invention relies on the temperature detected by the temperature sensing element to protect the compressor from being operated in an extremely low temperature atmosphere.

In the following, this invention will be described in further detail, referring to FIG. 12.

Figure 12:
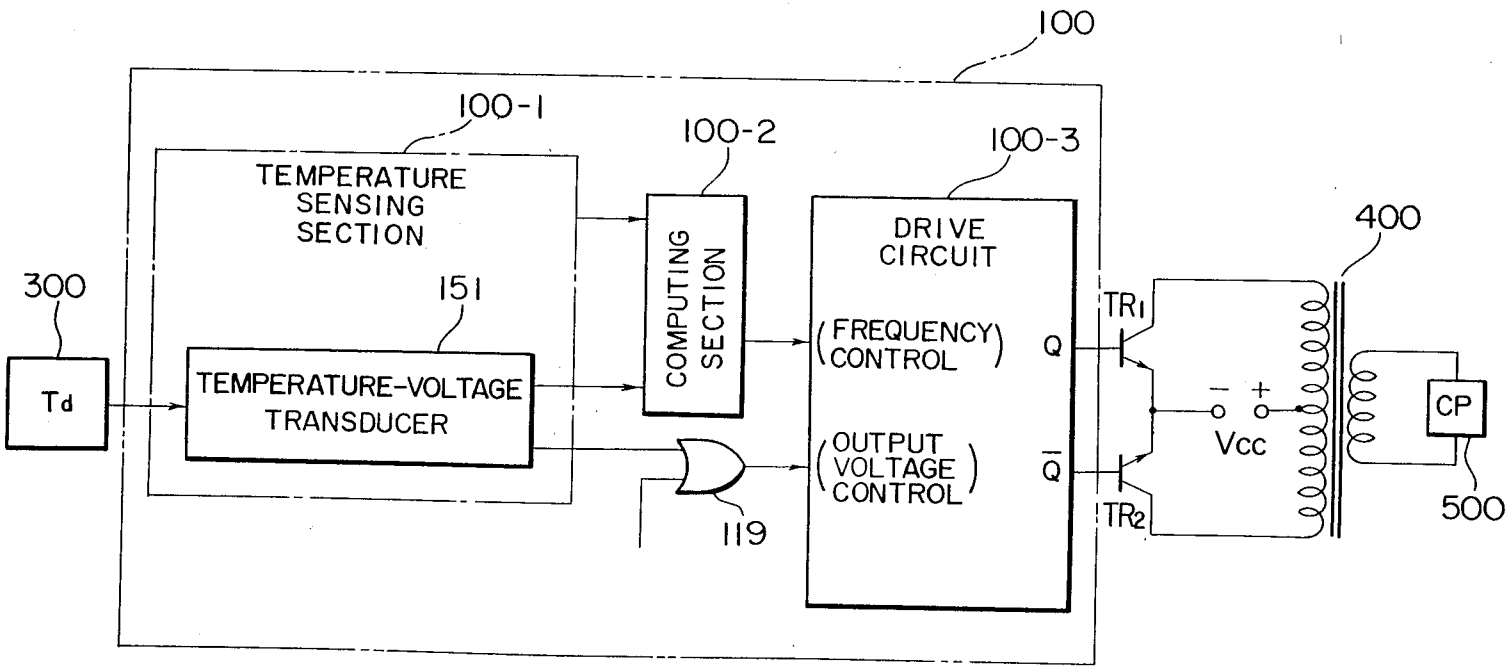
FIG. 12 shows an example of the system for protecting a compressor according to this invention.

In FIG. 12, numerals 100, 100-1, 100-2, 100-3, 300 through 500 and symbols $TR_1$ and $TR_2$ represent like parts shown in FIG. 8. Numeral 151 refers to a temperature-voltage transducer.

The temperature sensor 300 for detecting the temperature corresponding to the saturated vapor pressure of the refrigerant compressed and discharged by the compressor 500 is a thermistor, for example, and installed in the condenser 600. The temperature sensor 300 is the same as described with reference to FIG. 5, and in this invention, also acts as the temperature-voltage transducer 151 for converting the temperature signal detected by the temperature sensor 300 into an electrical signal. Consequently, the temperature detected by the temperature sensor 300 is converted into an electrical signal by the temperature-voltage transducer 151 in the temperature sensing section 100-1, which is provided corresponding to the temperature sensor 300. The resulting electrical signal is then input to the drive circuit 100-3 via the OR circuit 119 as an output voltage control signal to control the drive circuit 100-3, and caused to stop the drive circuit 100-3 in an extremely low temperature atmosphere.

In the drive circuit 100-3, a frequency control signal is input from the computing section 100-2; The frequency control signal has a voltage corresponding to a frequency at which the compressor 500 can operate in resonance with the resonance frequency of the mechanical system, as calculated on the basis of the "temperature corresponding to the suction pressure" detected by the temperature sensor 200 (not shown) and the "temperature corresponding to the discharge pressure" detected by the temperature sensor 300. Whereas the frequencies of the output Q and $\overline{Q}$ of the drive circuit 100-3 for driving the switching transistors $TR_1$ and $TR_2$ are determined by this frequency control signal, the drive circuit 100-3 has also such a construction that the outputs of the switching transistors $TR_1$ and $TR_2$ are controlled, or reduced as the atmospheric temperature lowers, by the output voltage control signal input to the drive circuit 100-3. If the car-board refrigerator starts operating in an extremely low temperature atmosphere, the drive circuit 100-3 is caused to stop operating by the extremely low temperature detected by the temperature sensor 300, and as a result the outputs Q and $\overline{Q}$ are caused to stop, interrupting the operation of the switching transistors $TR_1$ and $TR_2$. With this, the operation of the compressor 500 is stopped, and damage to the valve due to the overstroke of the compressor in an extremely low temperature atmosphere can be circumvented.

Another problem associated with the conventional type of vibrating compressor is that when a d-c input voltage to the control section in the operation control device for the vibrating compressor is excessively high, the overstroke of the compressor may result, damaging the compressor valve.

In this invention, a phase-controlling device is provided in the car-board refrigerator to prevent the voltage of the drive power from increasing by controlling the pulse width of the control signal for driving the switching transistors provided in the control section even when the d-c voltage to be input to the control section becomes excessively high.

Figure 13:
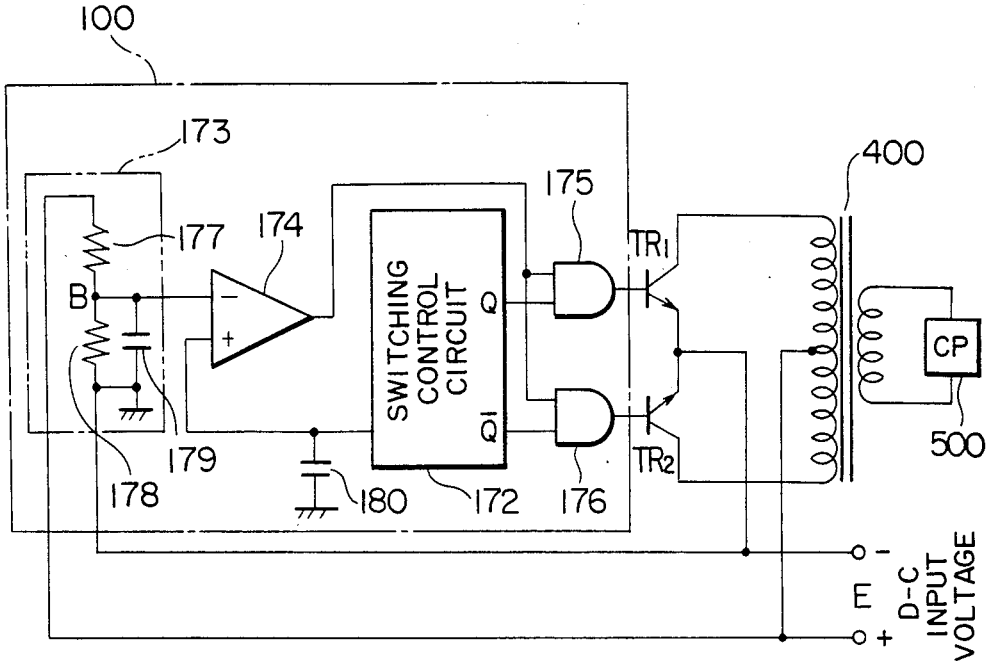
FIG. 13 shows an example of the control section according to this invention.
Figure 14:
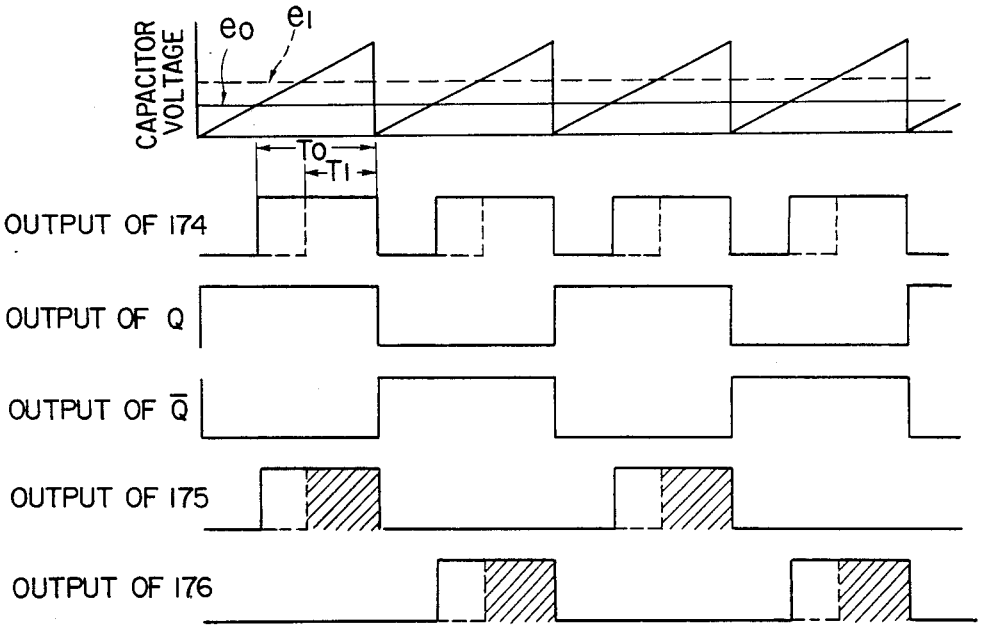
FIG. 14 is a working waveform diagram of assistance in explaining the operation of the examples shown in FIGS. 13 and 15.

Now, this invention will be described in detail, referring to FIG. 13 illustrating the construction of an embodiment and FIG. 14 showing a waveform diagram.

In FIG. 13, reference numerals 100, 400 and 500, and symbols $TR_1$ and $TR_2$ correspond with like parts shown in FIG. 8 described above. Numeral 172 refers to a switching control circuit; 173 to a level conversion circuit; 174 to a comparator; 175 and 176 to AND circuits; 177 and 178 to resistors; and 179 and 180 to capacitors, respectively.

The switching control circuit 172 corresponds with the drive circuit 100-3 in FIG. 5. AND circuits 175 and 176 are each connected across the outputs Q and $\overline{Q}$ of the switching control circuit 172 and the switching transistors $TR_1$ and $TR_2$. One input end each of the AND circuits 175 and 176 is connected in common to the output of the converter 174, and a capacitor 180 is connected to the positive input terminal of the comparator 174. Since the capacitor 180 is charged with the output voltage of the switching control circuit 172, a triangular wave voltage shown in FIG. 14 is input across both ends of the capacitor 180, that is, the positive input terminal of the comparator 174. A voltage appearing on a connecting point B of the resistors 177 and 178 comprising the level conversion circuit 173, that is, a portion of a d-c input voltage E divided by the resistors 177 and 178, is applied to the negative input terminal of the comparator 174. Consequently, as the d-c input voltage E fluctuates, the voltage applied to the negative input terminal of the comparator 174 also varies.

When the d-c input voltage E increases, the voltage at the point B on the level conversion circuit 173, that is, the voltage applied to the negative input terminal of the comparator 174 changes from $e_0$ to $e_1$ ($e_1 > e_0$). Since the triangular wave voltage charged in the capacitor 180 is applied to the positive input terminal of the comparator 174, the duration of time in which the comparator 174 outputs a logic "H" is reduced from $T_0$ to $T_1$ ($T_0 > T_1$), as shown in FIG. 14. As the output of the comparator 174 serves as a gate signal for the AND circuits 175 and 176, the duration of the outputs of the AND circuits 175 and 176 is also reduced to a duration as shown by hatched portions in FIG. 14. Thus, these signals with a reduced duration control the switching transistors $TR_1$ and $TR_2$ in such a fashion that phase control is effected so as to reduce the duration in which the switching transistors $TR_1$ and $TR_2$ are kept turned on. With this arrangement, even when the d-c input voltage increases, there is no fear of the stroke of the compressor 500 unwantedly increasing, leading to damage to the valve of the compressor 500.

Conversely, when the d-c input voltage decreases, phase control is effected so as to increase the duration in which the switching transistors $TR_1$ and $TR_2$ are kept turned on.

The vibrating compressor is usually operated so that the natural frequency of the mechanical system determined by the coefficient of elasticity of refrigerant gas and the spring coefficient of the resonating springs is maintained in a resonating state wherever possible with the vibrating frequency of the electrical system driving the mechanical system. When the car-board refrigerator is operated in a low temperature atmosphere, therefore, the vibrating frequency of the electrical system varies in accordance with the change in the natural frequency of the mechanical system so as to maintain the resonating state, resulting in an unwanted increase in the piston stroke of the compressor.

The phase-controlling device provided in the control device of the car-board refrigerator according to this invention is adapted to detect atmospheric temperature in the car-board refrigerator and control the control signal applied to the switching transistors in the control section for feeding a drive power to the compressor in accordance with the detected temperature to change the drive power voltage fed to the compressor from the control section in accordance with the detected temperature.

Figure 15:
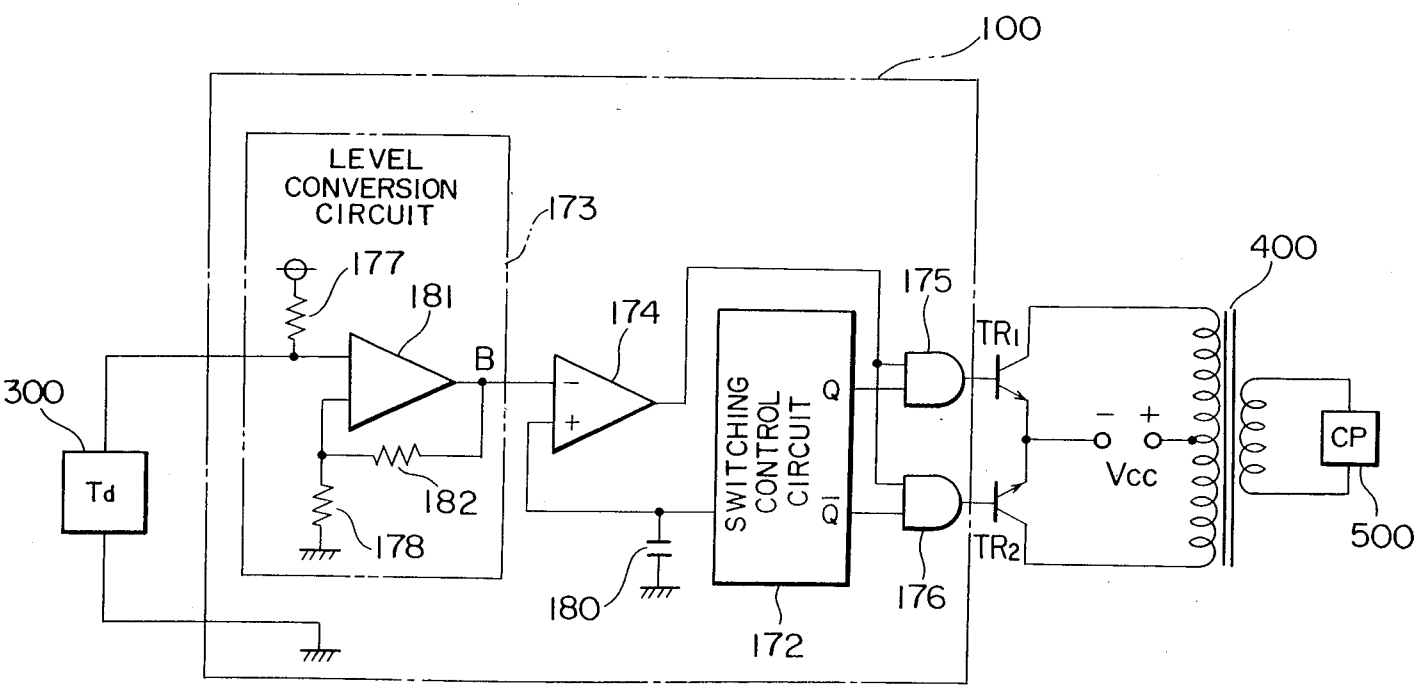
FIG. 15 shows another example of the control section according to this invention.

FIG. 15 shows another embodiment of the control section.

In the following, the operation of the control section will be described, referring to FIG. 15.

In FIG. 15, numeral 100, 300 through 500, and symbols $TR_1$ and $TR_2$ correspond to like parts shown in FIG. 5 described above. Numeral 172 refers to a switching control circuit; 173 to a level conversion circuit; 174 to a comparator; 175 and 176 to AND circuits; 177, 178 and 182 to resistors; 180 to a capacitor, and 181 to an amplifier, respectively.

The switching control circuit 172 corresponds to the drive circuit 100-3 shown in FIG. 5. The AND circuits 175 and 176 are each connected across the outputs Q and $\overline{Q}$ of the switching control circuit 172 and the switching transistors $TR_1$ and $TR_2$. One input end each of the AND circuits 175 and 176 is connected to the output of the comparator 174, and the capacitor 180 is connected to the positive input terminal of the comparator 174. As the capacitor 180 is charged by the output voltage from the switching control circuit 172, a triangular wave voltage as shown in FIG. 14 is input across the capacitor 180, that is, to the positive input terminal of the comparator 174. The negative input terminal of the comparator 174 is connected to the output end, that is a point B, of the level conversion circuit 173. The level conversion circuit 173 comprising the amplifier 181, the resistors 177, 178 and 182 amplifies the voltage generated in the temperature sensor 300 to an appropriate level, and produces the reference voltage to be input to the negative input terminal of the comparator 174. The temperature sensor 300 is a thermistor, for example, for detecting the temperature corresponding to the saturated vapor pressure of the refrigerant discharged by the compressor 500, as described with reference to FIG. 5. The temperature sensor 300 is installed on the condenser 600, and is a temperature sensing element for detecting the temperature corresponding to the saturated vapor pressure of the refrigerant compressed and discharged by the compressor 500, as described with reference to FIG. 5. Consequently, the temperature sensor 300 detects atmospheric temperature in the car-board refrigerator, and the output of the level conversion circuit 173 varies in accordance with the temperature detected by the temperature sensor 300.

When the temperature detected by the temperature sensor 300 lowers, the output of the level conversion circuit 173, that is, the reference voltage at the point B varies from the predetermined reference voltage $e_0$ to $e_1$ ($e_1 > e_0$). Furthermore, since the triangular wave voltage charged in the capacitor 180 is applied to the positive input terminal of the comparator 174, the duration in which the comparator 174 outputs a logic "H" is reduced from $T_0$ to $T_1$ ($T_0 > T_1$), as shown in FIG. 14. And, as the output of the comparator 174 serves as a gate signal for the AND circuits 175 and 176, the duration of the outputs of the gate circuits 175 and 176 is also reduced to a duration as shown by hatched portions in FIG. 14. By controlling the switching transistors $TR_1$ and $TR_2$ with these signals with a reduced duration, phase control is effected so as to reduce the duration in which the switching transistors $TR_1$ and $TR_2$ are kept turned on. With this, the drive power voltage feeding power to the compressor 500 via the transformer 400 is decreased and control is effected so as to reduce the stroke of the compressor 500 to protect the compressor 500.

Conversely, if the temperature detected by the temperature sensor 300 increases, phase control is effected so as to increase the duration in which the switching transistors $TR_1$ and $TR_2$ are kept turned on. Thus, the drive power voltage for driving the compressor 500 is increased.

In the conventional type of car-board refrigerator in which the vibrating compressor 500 is driven by a drive power having the same frequency as the resonance frequency of the compressor 500, a power switch is provided only to make or break the power line to feed or cut off power to the compressor. This necessitates the power switch to be installed at a location where the switch can be operated easily from outside, leading to redundant wiring of the power line, causing an unwanted voltage drop and power consumption. Furthermore, the making or breaking of the power line results in severe wear of the switch contacts. This, together with the use of alternating current, makes it necessary to use a large capacity and high withstand-voltage switch.

The power switch according to this invention has such a construction that the power to the compressor is fed or interrupted with an on-off signal fed through a control signal line, instead of making or breaking the power line.

Figure 16:
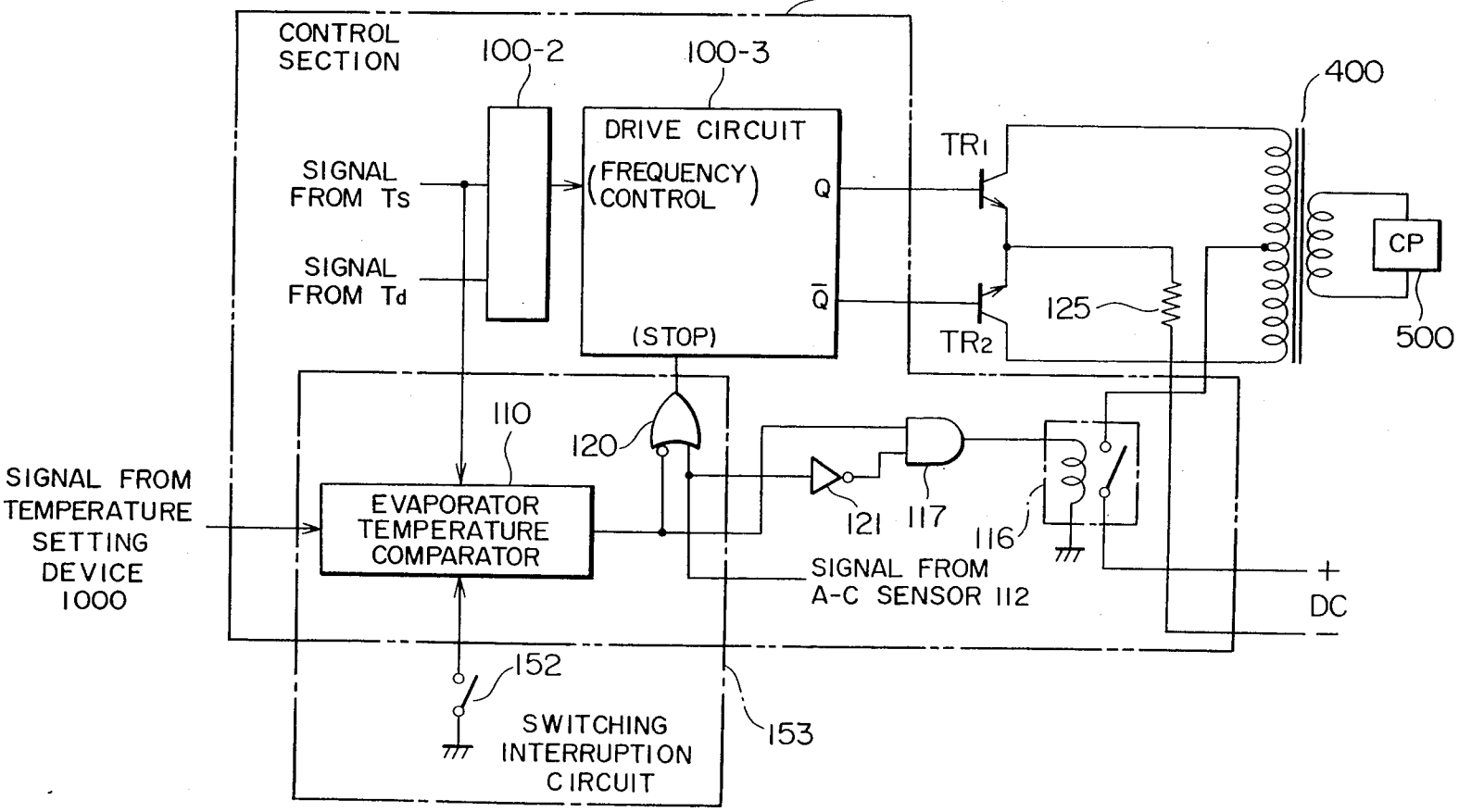
FIG. 16 shows an example relating to the power switch of the control section according to this invention.

FIG. 16 shows a control section embodying this invention, which is an improved version of the control section shown in FIG. 5.

In FIG. 16, reference numerals 100, 100-2, 100-3, 400 and 500, and symbols $TR_1$ and $TR_2$ correspond to like parts shown in FIG. 5. Numerals 110, 120, 117, 120, 121 and 125 correspond to like parts shown in FIG. 8. Numeral 153 refers to a control interruption circuit; 152 to a power switch, respectively.

The switching interruption circuit 153 consists of the evaporator temperature comparator 110, the OR circuit 120 and the power switch 152. The outputs Q and $\overline{Q}$ alternately generated at a certain resonance frequency by the drive circuit 100-3 are interrupted by a logic "H" output by the control interruption circuit 153 to the drive circuit 100-3.

As described above, the evaporator temperature comparator 110 electrically compares the refrigerator inside temperature setting set by the temperature setting device 1000 with the signal from $T_s$, that is, the temperature on the evaporator side, and when the temperature on the evaporator side becomes lower than the refrigerator inside temperature setting set by the temperature setting device 1000, outputs a logic "L" via an AND circuit provided in the evaporator temperature comparator 110, which will be described later. The logic "L" from the evaporator temperature comparator 110 acts as a stop signal for the drive circuit 100-3 via the OR circuit 120, and at the same time deenergizes the AND circuit 117 to interrupt the supply of d-c voltage to the switching transistors $TR_1$ and $TR_2$.

When the power switch 152 is in the off state, the logic "H" is input to the AND circuit provided in the evaporator temperature comparator 110, and the control section 100 turns on and off the power switch 152 based on the signal from the temperature setting device 1000. When the power switch 152 is turned to the on state, the logic "L" is input to the AND circuit provided in the evaporator temperature comparator 110. With this, the logic "L" is output from the AND circuit. That is, the logic "L" is output from the evaporator temperature comparator 110. As described above, the logic "L" serves as a stop signal for the drive circuit 100-3, and interrupts the supply of d-c voltage to the switching transistors $TR_1$ and $TR_2$. In this way, the supply and cutoff of the power to the compressor 500 can be controlled based on a signal from the control section which turns on and off the power switch 152.

Figure 17:
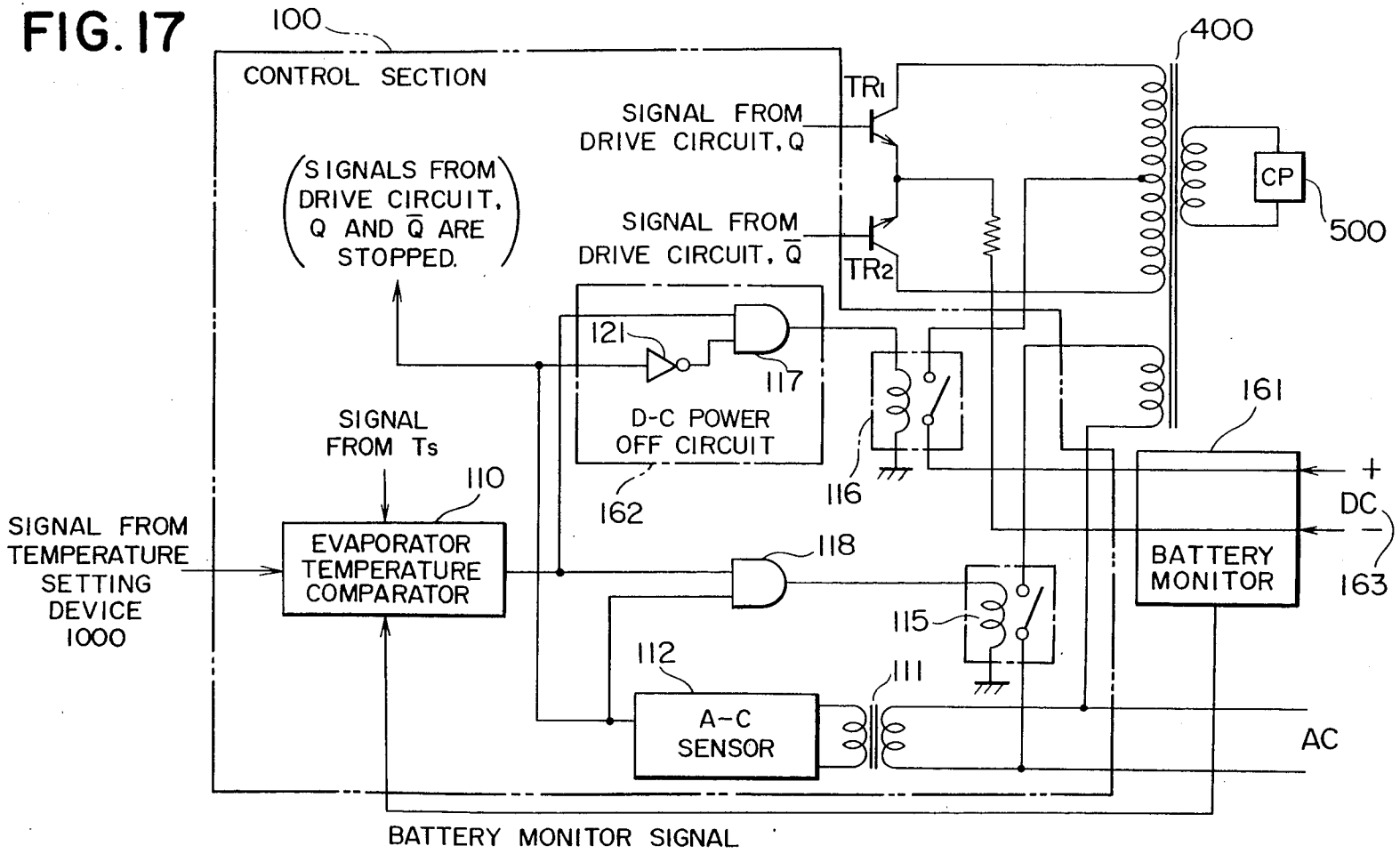
FIG. 17 shows an example relating to the d-c power supply of the control section according to this invention.

FIG. 17 shows a control section embodying this invention in relation to the d-c power supply. This control section has such a construction that when the d-c power voltage applied to the control section by a battery lowers below a predetermined voltage level, the control section receives a battery monitor signal output by a battery monitor to output a power off signal from the evaporator temperature comparator to interrupt the d-c power supply to the control section.

Figure 18:
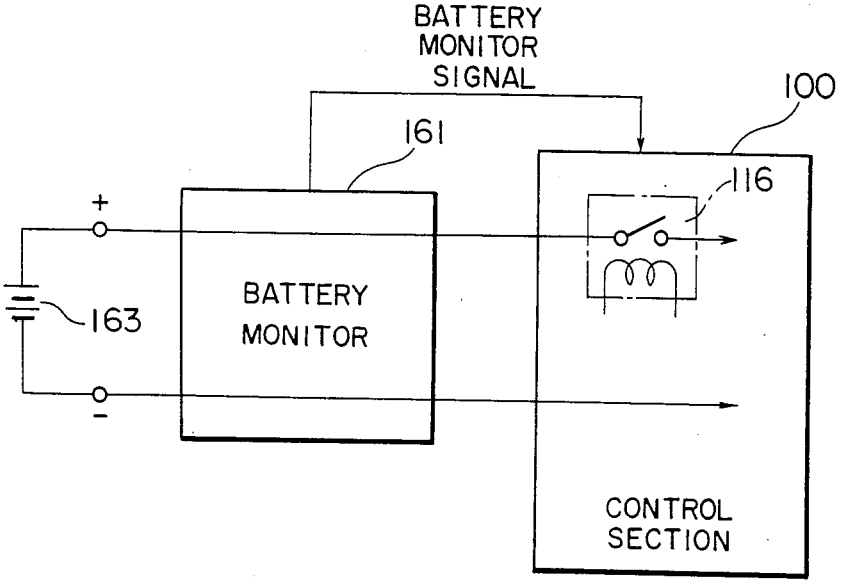
FIG. 18 is a diagram of assistance in explaining an embodiment of this invention to be used in conjunction with FIG. 17.

In FIGS. 17 and 18, reference numerals 100, 400 and 500, and symbols $TR_1$ and $TR_2$ correspond to like parts shown in FIG. 5, and numerals 110 through 112, 115 through 118, and 121 correspond to like parts shown in FIG. 8. Numeral 161 refers to a battery monitor; 162 to a d-c power off circuit; 163 to a battery, respectively.

The d-c power off circuit 162 consists of the AND circuit 117 and the inverter 121, to which a logic "L" is input from the alternating current detector 112 so long as an alternating current is not used. And, the logic "L" is converted to a logic "H" in the inverter 121 to input to the AND circuit 117. An input end of the AND circuit 117 is connected to the output end of the evaporator temperature comparator 110, and the d-c power relay 116 is energized or deenergized based on the output of the evaporator temperature comparator 110. In other words, when the output of the evaporator temperature comparator 110 is a logic "H", the d-c power relay 116 is energized via the d-c power off circuit 162, and as a result the d-c power is fed to the switching transistors $TR_1$ and $TR_2$ via the transformer 400 from the battery 163. Furthermore, when the output of the evaporator temperature comparator 110 is a logic "L", the d-c power relay 116 is deenergized by the d-c power off circuit 162, interrupting the supply of d-c power by the battery 163 to the switching transistors $TR_1$ and $TR_2$ and stopping the signals Q and $\overline{Q}$ from the drive circuit 100-3.

The battery monitor 161 monitors the power voltage fed from the battery 163 to the battery monitor 161, and when the power voltage from the battery 163 lowers below a predetermined voltage level, outputs a logic "H" as a battery monitor signal to the control section 100. The battery monitor signal is input to the evaporator temperature comparator 110 in the control section.

As described above, the evaporator temperature comparator 110 electrically compares the refrigerator inside temperature setting set by the temperature setting device 1000 with the signal from $T_s$, that is, the temperature on the side of an evaporator 800-1. When the temperature on the side of the evaporator 800-1 lowers below the refrigerator inside temperature setting set by the temperature setting device 1000, the evaporator temperature comparator 110 outputs a logic "L", deenergizing the d-c power relay 116 via the d-c power off circuit 162 to interrupt the d-c power supply to the switching transistors $TR_1$ and $TR_2$. Upon receiving a battery monitor signal indicating that the battery voltage from the battery monitor 161 is lower than a given voltage, the evaporator temperature comparator 110 preferentially outputs a logic "L" as a power off signal. The power off signal, or the logic "L", interrupts the d-c power supply to the switching transistors $TR_1$ and $TR_2$, turning off the switching transistors $TR_1$ and $TR_2$, as described above.

Figure 1:
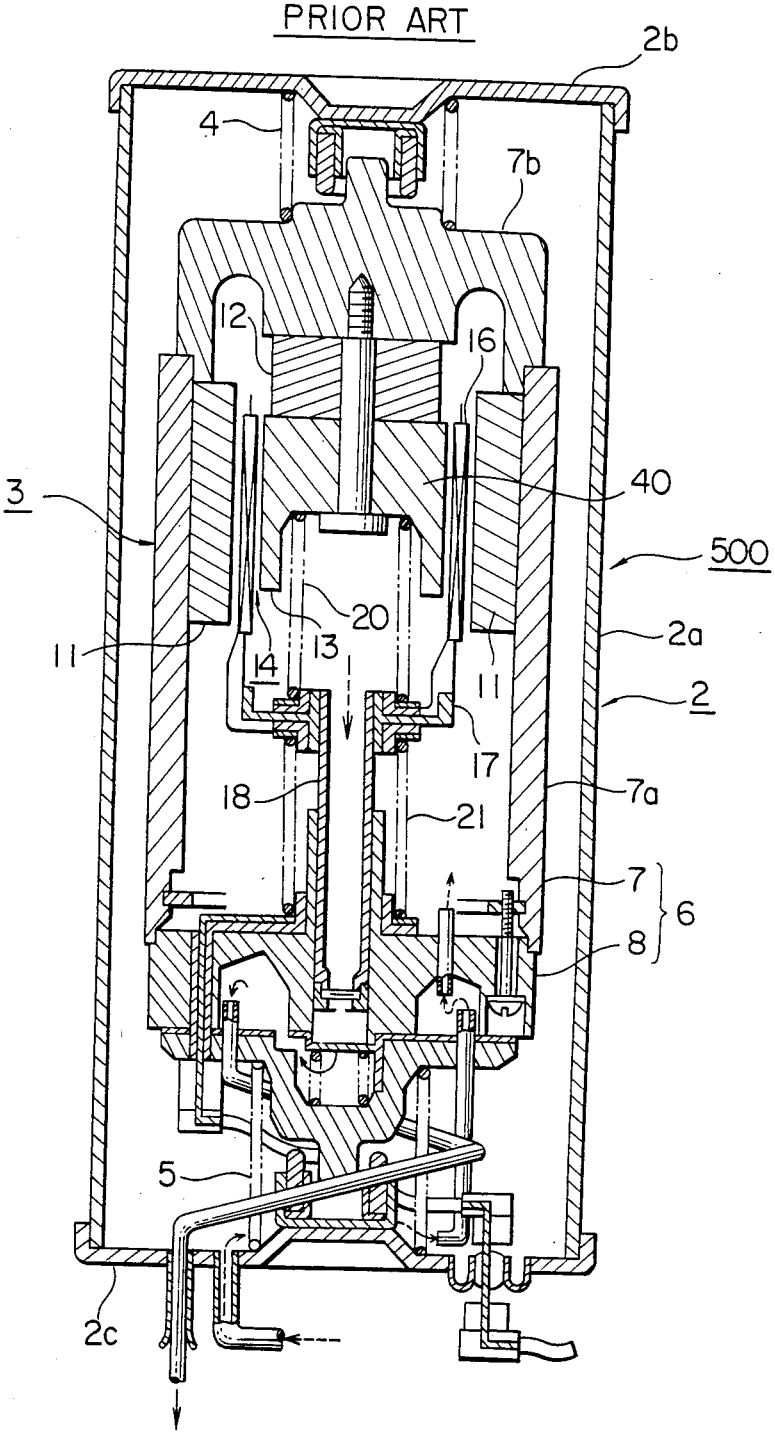
FIG. 1 PRIOR ART
FIG. 1 is a diagram illustrating an example of the vibrating compressor which is to be controlled by this invention.
Figure 2:
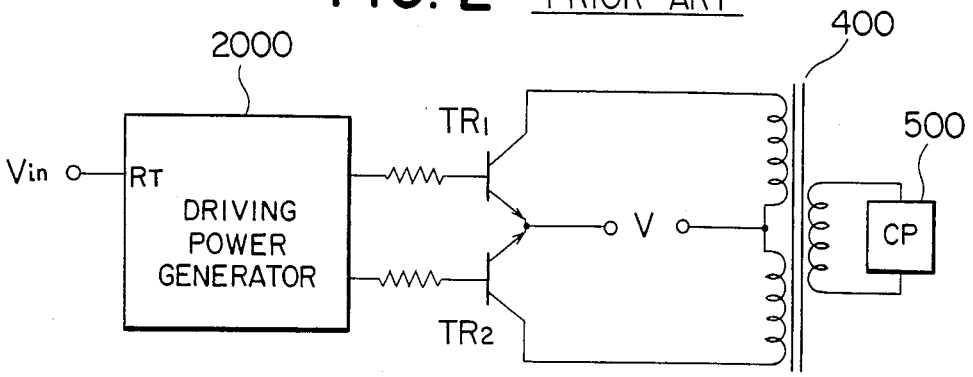
FIG. 2 PRIOR ART
FIG. 2 is a diagram illustrating a conventional system for controlling the operation of a vibrating compressor.
Figure 3:
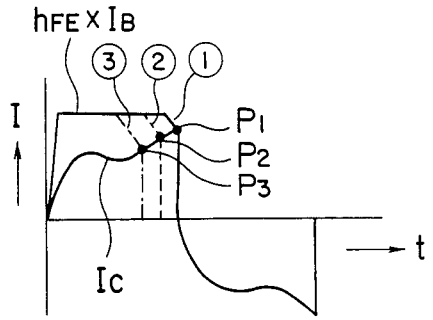
FIG. 3 PRIOR ART
FIG. 3 is a diagram of assistance in explaining the operation of the system for controlling the operation of a vibrating compressor shown in FIG. 2.
Figure 4:
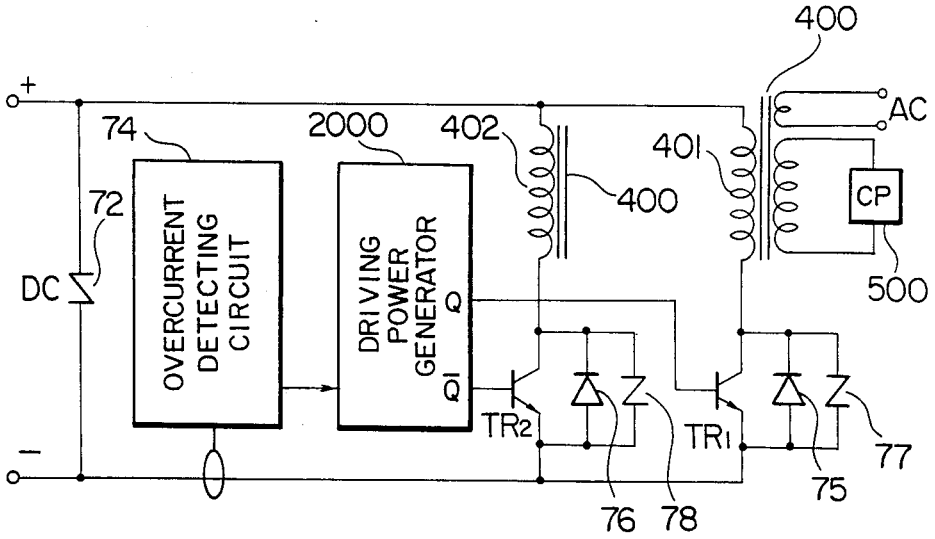
FIG. 4 PRIOR ART
FIG. 4 is a circuit diagram of a conventional surge voltage suppression circuit for car-board refrigerators.
Figure 19:
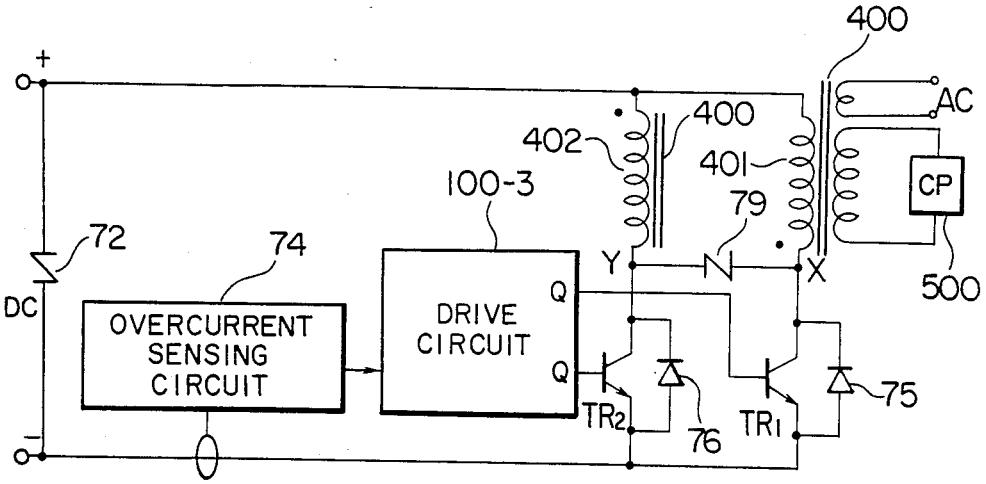
FIG. 19 shows an example relating to the surge voltage suppression of the control section according to this invention.

FIG. 19 shows a control section embodying this invention which is an improved version of the conventional surge voltage control circuit shown in FIG. 4. The control section has such a construction that a surge voltage suppression element is provided across points connecting each of alternately operating switching elements to each winding of the transformer to suppress surge voltages generated by electromagnetic induction in the transformer caused by the operation of the switching elements.

In the following, this invention will be described, referring to FIG. 19.

In FIG. 19, reference numerals 100-3, 400 and 500, and symbols $TR_1$ and $TR_2$ correspond to like parts shown in FIG. 5, and numerals 401, 402, 72, 74 through 76 correspond to like parts shown in FIG. 4, which has been described earlier. Numeral 79 refers to a varistor as an element absorbing surge voltage. The varistor 79 is connected to points X and Y each connecting each collector of the switching transistors $TR_1$ and $TR_2$ with the windings 401 and 402 of the transformer 400.

Now, assume that the switching transistor $TR_1$, for example, is turned off. Then, a surge voltage 2E twice as large as a d-c input voltage E is generated in the winding 401 of the transformer 400 by electromagnetic induction. Since the switching transistor $TR_2$ is turned on as soon as the switching transistor $TR_1$ is turned off, the switching transistor $TR_2$ is in the on state as sonn as the surge voltage 2E is generated. Thus, the voltage between the point Y and the cathode is equal to the saturated voltage $V_{CE2}$ of the transistor $TR_2$. Consequently, the surge voltage generated by the turning-off of the transistor $TR_1$ is such that assuming that the voltage across the varistor 79 is $V_0$ when current flows in the varistor 79 and the transistor $TR_2$, the voltage between the point X and the cathode is equal to $V_0+V_{CE}$, which is applied between the emitter and collector of the turned-off transistor $TR_1$. This means that since $V_{CE}$ is very small and $E>V_0+V_{CE}$, the surge voltage applied to the turned-off transistor $TR_1$ is suppressed.

Conversely, when the transistor $TR_2$ is turned off, exactly the same phenomenon takes place. When both the transistor $TR_1$ and $TR_2$ are turned on, there is a likelihood that a voltage $E+V_0+V_{CE}$ is applied. In this case, too, the transistors $TR_1$ and $TR_2$ are protected from destruction since the voltage $V_0+V_{CE}$ is a very small value.

It can be conceived that similar protection is provided for the transistors $TR_1$ and $TR_2$ by eliminating the varistor 79 and setting the on voltage of the varistor 72 at a low level. This arrangement, however, is not practical because the current flowing in the varistor 72 may become extremely large. By providing a varistor 79, as described above, the on voltage of the varistor can be set at a high level. The above-mentioned protection against surge voltages is effective for surge voltages from an a-c power supply when driving the refrigerator with an a-c power.

Figure 20:
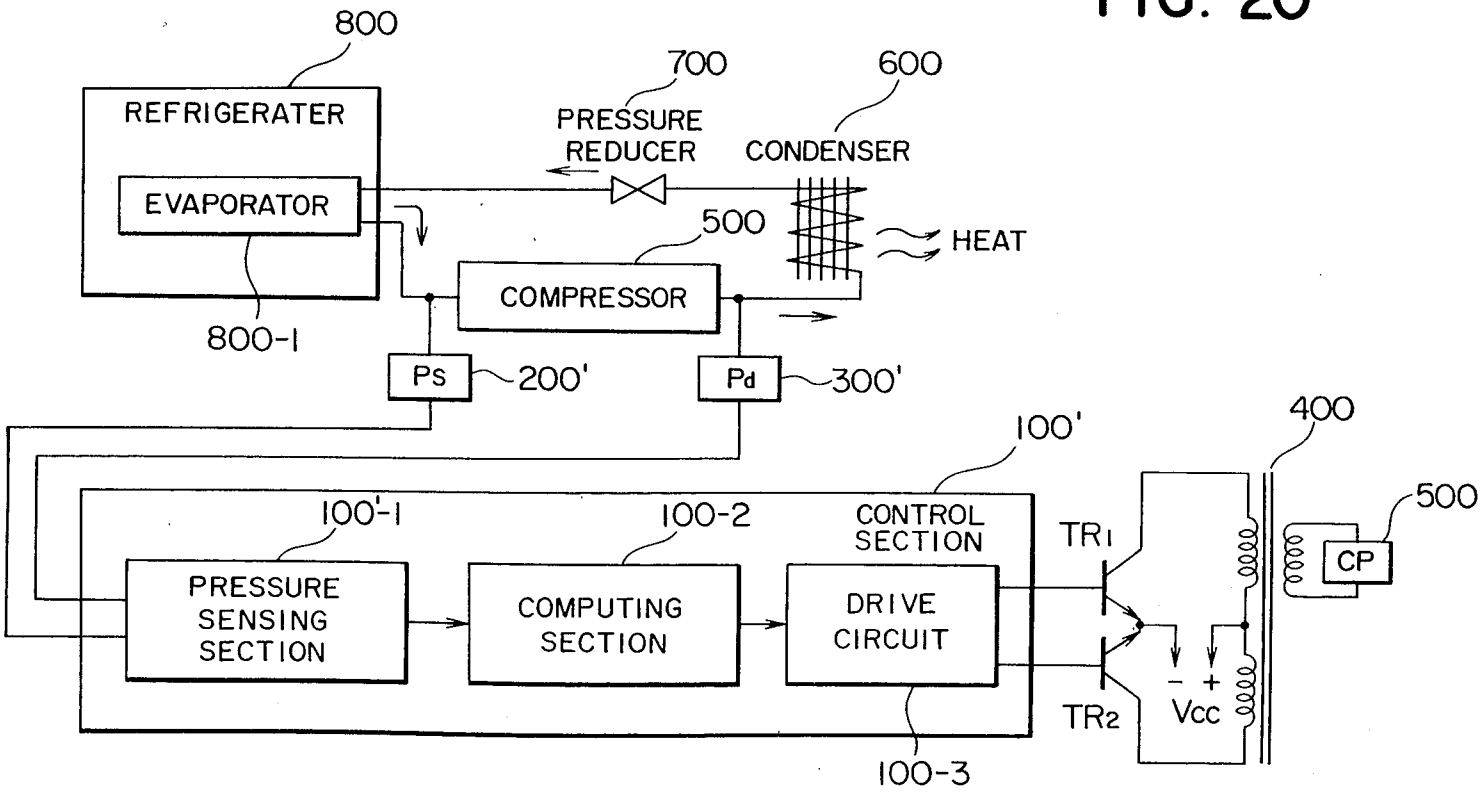
FIG. 20 shows still another embodiment relating to the system for controlling the operation of the vibrating compressor according to this invention.
Figure 21:
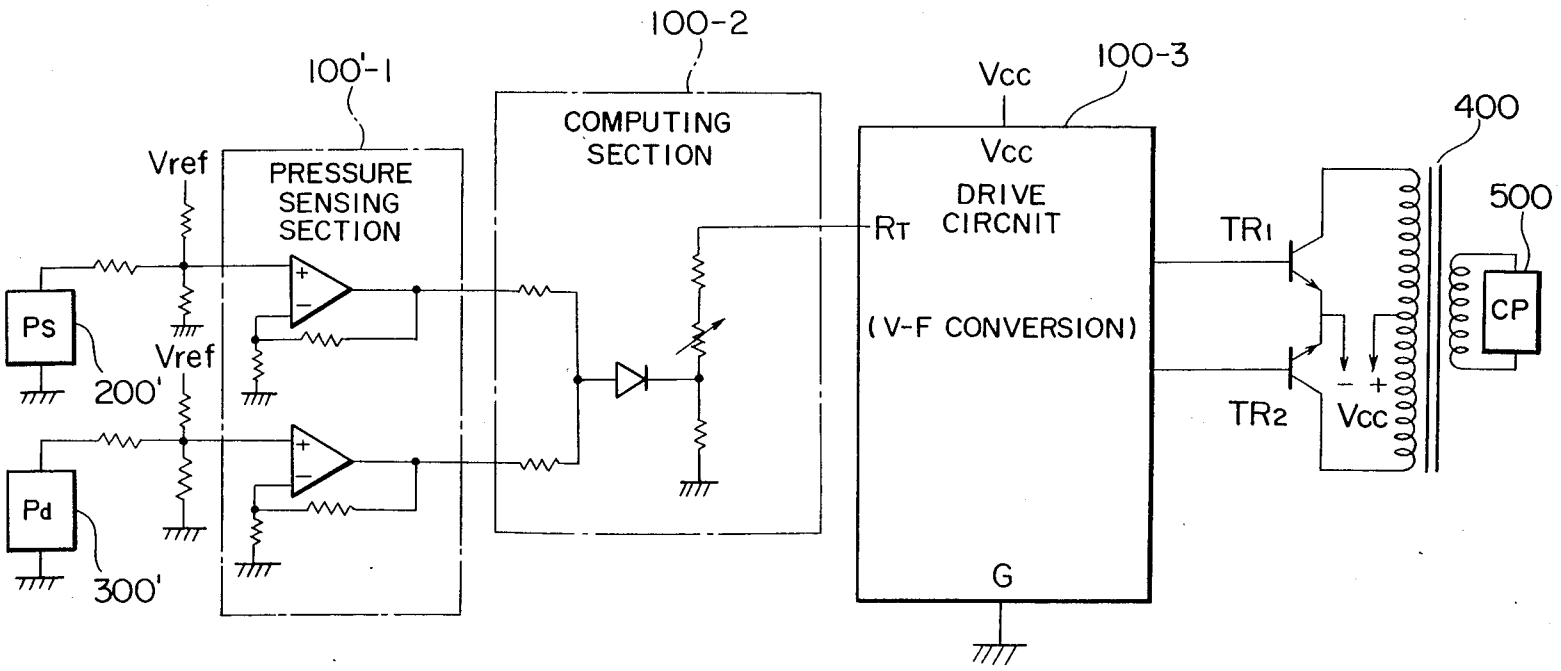
FIG. 21 is a diagram illustrating the construction of the essential parts of the embodiment shown in FIG. 20.

FIG. 20 shows another embodiment of the system for controlling the operation of the compressor, in which pressure is detected using a pressure sensor, instead of the temperature sensor shown in FIG. 5, to control the operation of the compressor by the control section 100 based on the detected pressure. FIG. 21 is a diagram illustrating the construction of essential parts of an embodiment of this invention shown in FIG. 5. Components corresponding to FIGS. 5 and 6 are shown by like reference numerals in FIGS. 20 and 21, too.

In FIG. 20, a control section 100 consists of a pressure sensor 100-1, a computing section 100-2 and a drive circuit 100-3, and is used for supplying a drive signal of such a frequency that a compressor 500 is operated in resonance therewith, based on signals from a pressure sensor ($P_s$) 200 for detecting the suction pressure of the refrigerant sucked by the compressor 500 and a pressure sensor ($P_d$) 300 for detecting the discharge pressure of the refrigerant compressed and discharged by the compressor 500. The vibrating compressor 500 receiving a drive power generated by a drive signal supplied by the control section 100 compresses a refrigerant into a mixture of gaseous and liquid refrigerant, which is in turn fed to a condenser 600 where the mixture is liquefied by discharging the heat. The liquefied refrigerant is fed via a pressure reducer 700 to an evaporator 800-1 provided in a refrigerator 800, where the refrigerant is gasified, taking the heat of evaporation to cool the refrigerator. The gasified refrigerant is then compressed by the compressor 500 for liquefaction. By repeating the aforementioned closed cycle, the heat taken in the evaporator 800-1 is discharged in the condenser 600. In the following, the operation of the control section will be described.

In the figure, a pressure sensing section 100'-1 is used for converting signals detected by pressure sensors 200' and 300' into predetermined electrical signals.

In the figure, a computing section 100-2 is used for producing a drive power having a predetermined frequency based on the electrical signals corresponding to the suction pressure and the discharge pressure converted by the pressure sensing section 100'-1. A drive circuit 100-3 is for supplying current in an alternately switching square waveform from a d-c power supply $V_{cc}$ to the primary windings of a transformer 400 by feeding a drive signal having a frequency corresponding to the voltage supplied by the computing section 100-2. An alternating current obtained from the secondary winding of the transformer 400 is supplied to the compressor 500. Thus, the compressor 500 is operated at the maximum operating efficiency.

In FIG. 21, the manner in which the compressor 500 is operated in a resonating state is virtually the same as shown in FIG. 6, except that pressure is detected, instead of temperature. Detailed description of FIG. 21 is therefore omitted here.

Next, the operation of the construction shown in FIG. 21 will be described briefly.

In the figure, the suction pressure ($P_s$) signal and the discharge signal ($P_d$) detected by pressure sensors 200' and 300' are each input to the positive terminal of each operational amplifier in the pressure sensing section 100'-1 for amplification to predetermined levels. Each of the amplified signals is calculated by the resistor network in the computing section 100-2 as shown in the figure to obtain the value of "$K_{ps}+K_{pd}$" in Equation, (2) relating to the spring constant as described in FIG. 6. The calculated signals are then fed to the drive circuit 100-3 and converted in terms of voltage and frequency into square wave signals corresponding to the signals. The square wave signals converted in terms of voltage and frequency are fed to $TR_1$ and $TR_2$, and current with alternately changing polarities is fed from the d-c power supply $V_{cc}$ to the primary windings of the transformer 400. And an alternating current voltage obtained from the secondary winding of the transformer 400 is fed to the compressor 500. Thus, the compressor 500 can be operated at the maximum efficiency, that is, in such a state that the frequency of the drive power for driving the compressor 500 is kept in resonance, while relating to the suction pressure of the refrigerant sucked by the compressor 500 and the discharge pressure of the refrigerant compressed and discharged by the compressor 500.

As described above, this invention makes it possible to control the operation of a vibrating compressor since this invention adopts a construction that a drive power having a frequency corresponding to the suction pressure and discharge pressures of refrigerant is fed to the compressor.

What is claimed is:

1. A system for controlling the operation of a vibrating compressor comprising: a first sensor for detecting the pressure of the refrigerant sucked by the compressor; a second sensor for detecting the pressure of the refrigerant compressed and discharged by the compressor; control means including means for converting signals detected by said first and second pressure sensors into predetermined electrical signals; computing means for generating an output having a predetermined frequency representing the frequency at which the compressor can operate at the resonant frequency based on the electrical signal from said pressure sensing means; and, a drive circuit for generating a drive signal corresponding to said output fed by said computing section.

2. A system for controlling the operation of a vibrating compressor set forth in claim 1 wherein said controlling system comprises a sucked refrigerant pressure sensor for detecting the suction pressure of the refrigerant sucked by said compressor, a discharged refrigerant pressure sensor for detecting the discharge pressure of the refrigerant compressed and discharged by said compressor, and a computing section for generating an output having a predetermined frequency based on pressure signals detected by said sucked refrigerant pressure sensor and said discharged refrigerant pressure sensor; and a drive circuit generates outputs Q and $\overline{Q}$ having the frequency corresponding to the output fed by said computing section.

3. A system for controlling the operation of a vibrating compressor set forth in claim 1 wherein said drive circuit comprises a high-speed operating switching control circuit to which a triangular wave voltage and a phase-controlling voltage are input and the width of whose output pulse varies with the input level of said phase-controlling voltage, and has such a construction that said compressor is driven by a drive power generated by said switching control circuit; and a low-speed operating comparator to which said triangular wave voltage and said phase-controlling voltage applied to said high-speed operating switching control circuit are input is provided, and has such a construction that a square wave output of said comparator is substituted for said phase-controlling voltage from said high-speed operating switching control circuit so as to positively ensure switching at low frequencies.

4. A system for controlling the operation of a vibrating compressor set forth in claim 1 wherein a current sensing element for detecting the load current of said drive circuit, and a switching interruption circuit for interrupting the operation of switching elements provided in said drive circuit when a current flows over the predetermined level in said current sensing element are provided so that the oscillation of said drive circuit is interrupted when an overcurrent flows in said current sensing element.

5. A system for controlling the operation of a vibrating compressor set forth in claim 1 wherein said controlling system has such a construction that the output of switching elements provided in a drive circuit, which is driven at said predetermined frequency, is controlled based on the detected pressure by a discharged refrigerant pressure sensor so as to furnish a function for protecting said compressor in a low-temperature atmosphere in a car-board refrigerator.

6. A system for controlling the operation of a vibrating compressor set forth in claim 1 wherein a comparator is provided so as to vary a reference voltage applied to said comparator in accordance with a d-c input voltage applied to said drive circuit and control a drive power in accordance with said d-c input voltage by means of the output of said comparator.

7. A system for controlling the operation of a vibrating compressor set forth in claim 1 wherein a level conversion circuit for generating a reference voltage in accordance with the pressure detected by said discharged refrigerant pressure sensor, a comparator for comparing a reference voltage generated by said level conversion circuit, which varies with the pressure detected by said discharged refrigerant pressure sensor with a triangular wave voltage applied to said switching control circuit, and a gate circuit for allowing each of outputs Q and $\overline{Q}$ of said switching control circuit to pass by using the output of said comparator, which varies with the pressure detected by said discharged refrigerant temperature sensor as a gate are provided so as to control a drive power generated by said control section in accordance with the pressure detected by said discharged refrigerant temperature sensor.

8. A system for controlling the operation of a vibrating compressor set forth in claim 1 wherein an evaporator temperature comparator for comparing a signal corresponding to pressure in said evaporator with a signal corresponding to temperature setting fed rrom a temperature setting device which detects temperature in said refrigerator, and a switching interruption means for interrupting switching elements porvided in said control section are provided so as to interrupt the operation of said switching elements by the output of said evaporator temperature comparator via said switching interruption means.

9. A system for controlling the operation of a vibrating compressor set forth in claim 1 wherein said control section comprises a d-c power relay for feeding a d-c power, a d-c power off circuit for breaking the contacts of said d-c power relay when an alternating current power is applied, an evaporator temperature comparator which outputs a power off signal for breaking the contacts of said d-c power relay via said d-c power off circuit, and has such a construction that when a battery voltage applied to said control section as a d-c power lowers below a predetermined voltage level, said evaporator temperature comparator outputs a power off signal upon receiving a battery monitor signal generated by a battery monitor, so that the supply of a d-c power to said switching elements when said battery voltage lowers below a predetermined voltage level.

10. A system for controlling the operation of a vibrating compressor set forth in claim 1 wherein said control section comprises a d-c power relay for feeding a d-c power, a battery monitor for generating a battery monitor signal when a battery voltage applied to said control section as a d-c power lowers below a predetermined voltage level so as to control said d-c power relay and interrupt the supply of a d-c power to said switching elements.

11. A system for controlling the operation of a vibrating compressor set forth in claim 1 wherein said control section comprises alternately operating switching elements, a drive circuit for operating said switching elements at a predetermined frequency; and a transformer for generating an alternating current voltage by the alternate operation of said switching elements and a surge voltage suppression element are provided at points connecting said alternately operating switching elements and each winding of said transformer so as to suppress surge voltages caused by electromagnetic induction in said transformer along with the operation of said switching elements.

12. A system for controlling the operation of a vibrating compressor using a predetermined frequency corresponding to the load thereof, and characterized in that said controlling method comprises at least a first sensor for detecting a first parameter of a refrigerant sucked by said compressor, a second sensor for detecting a second parameter of said refrigerant compressed and discharged by said compressor, a parameter sensing section for converting signals detected by said first and second sensors into predetermined electrical signals, a computing section for generating an output having a predetermined frequency based on said electrical signals from said parameter sensing section, a drive circuit for generating a drive signal in accordance with an output fed from said computing section, switching elements which are turned on and off by said drive circuit, a transformer for supplying an output from said switching elements and an alternating current power in an a-c operation, a switching interruption circuit means for interrupting the operation of said switching elements, a temperature setting device for detecting the temperature of an object being refrigerated by said refrigerant, a temperature comparator for generating a control signal based on a detected temperature signal from said temperature setting device an a-c sensor for detecting the occurrence of said a-c operation, a surge absorbing circuit for monitoring a d-c voltage for feeding a d-c power to said switching elements, and an overcurrent sensing circuit for detecting an overcurrent fed by said switching elements, and characterized in that said switching elements are turned off in response to the output from said temperature comparator, said a-c sensor and said overcurrent sensor via said switching interruption circuit means while said compressor is driven by turning on and off said switching elements, and the magnitude of vibrating stroke in said vibrating compressor is controlled by controlling said switching elements based on the output of said surge absorbing circuit.

13. A system for controlling the operation of a vibrating compressor comprising: a first sensor for detecting a first parameter of a refrigerant sucked by the compressor corresponding to the suction pressure; a second sensor for detecting a second parameter of the refrigerant compressed and discharged by the compressor corresponding to the discharge pressure; control means for calculating, based on the suction pressure and discharge pressure, a frequency at which the compressor can operate at the resonant frequency and for producing drive power having a predetermined frequency based on the calculated frequency, the compressor being driven by using said power drive generated by said control means.

14. A system for controlling the operation of a vibrating compressor having an evaporator and a refrigerator comprising: a first temperature sensor for detecting the temperature of a refrigerant sucked by said compressor; a second temperature sensor for detecting a temperature of the refrigerant compressed and discharged by the compressor; control means for converting signals detected by said first and second temperature sensors into predetermined electrical signals; computing means for generating an output having a predetermined frequency based on the electrical signals provided by the temperature sensing section corresponding to a frequency at which the compressor can operate at the resonant frequency; a drive circuit for generating a drive signal corresponding to said output supplied by said computing section; a temperature comparator for comparing the temperature signal corresponding to said first temperature sensor and the temperature signal corresponding to said second temperature sensor; and, a switching interruption means for interrupting switching elements provided in said control means so as to interrupt the operation of said switching elements in accordance with signals produced by said temperature comparator means.

15. A system for controlling the operation of a vibrating compressor comprising: a sucked refrigerant temperature sensor for detecting a temperature corresponding to the saturated vapor pressure of a refrigerant sucked by the compressor; a discharged refrigerant temperature sensor for detecting a temperature corresponding to the saturated vapor pressure of the refrigerant compressed and discharged by said compressor; computing means for generating an output having a predetermined frequency at which the compressor can operate at the resonant frequency based on the sucked and discharged refrigerant temperature sensed corresponding to the saturated vapor pressure of the refrigerant sucked and discharged; and, a drive circuit for generating a drive signal corresponding to outputs Q and $\overline{Q}$ having the frequency corresponding to the output fed by said computing means.

16. A system for controlling the operation of a vibrating compressor set forth in claim 15 wherein said drive circuit comprises a high-speed operating switching control circuit to which a triangular wave voltage and a phase-controlling voltage are input and the width of whose output pluse varies with the input level of said phase-controlling voltage, and has such a construction that said compressor is driven by a drive power generated by said switching control circuit; and a low-speed operating comparator to which said triangular wave voltage and said phase-controlling voltage applied to said high-speed operating switching control circuit are input is provided, and has such a construction that a square wave output of said comparator is substituted for said phase-controlling voltage from said high-speed operating switching control circuit so as to positively ensure switching at low frequencies.

17. A system for controlling the operation of a vibrating compressor set forth in claim 15 wherein a current sensing element for detecting the load current of said drive circuit, and a switching interruption circuit for interrupting the operation of switching elements provided in said drive circuit when a current flows over the predetermined level in said current sensing element are provided so that the oscillation of said drive circuit is interrupted when an overcurrent flows in said current sensing element.

18. A system for controlling the operation of a vibrating compressor set forth in claim 15 wherein said controlling system has such a construction that the output of switching elements provided in a drive circuit, which is driven at said predetermined frequency, is controlled based on the detected temperature by a discharged refrigerant temperature sensor so as to furnish a function for protecting said compressor in a low-temperature atmosphere in a car-board refrigerator.

19. A system for controlling the operation of a vibrating compressor set forth in claim 15 wherein a comparator is provided so as to vary a reference voltage applied to said comparator in accordance with a d-c input voltage applied to said drive circuit and control a drive power in accordance with said d-c input voltage by means of the output of said comparator.

20. A system for controlling the operation of a vibrating compressor set forth in claim 15 wherein a level conversion circuit for generating a reference voltage in accordance with the temperature detected by said discharged refrigerant temperature sensor, a comparator for comparing a reference voltage generated by said level conversion circuit, which varies with the temperature detected by said discharged refrigerant temperature sensor with a triangular wave voltage applied to said switching control circuit, and a gate circuit for allowing each of outputs Q and $\overline{Q}$ of said switching control circuit to pass by using the output of said comparator, which varies with the temperature detected by said discharged refrigerant temperature sensor as a gate are provided so as to control a drive power generated by said control section in accordance with the temperature detected by said discharged refrigerant temperature sensor.

21. A system for controlling the operation of a vibrating compressor set forth in claim 15 wherein said control section comprises a d-c power relay for feeding a d-c power, a d-c power off circuit for breaking the contacts of said d-c power relay when an alternating current power is applied, an evaporator temperature comparator which outputs a power off signal for breaking the contacts of said d-c power relay via said d-c power off circuit, and has such a construction that when a battery voltage applied to said control section as a d-c power lowers below a predetermined voltage level, said evaporator temperature comparator out-puts a power off signal upon receiving a battery monitor signal generated by a battery monitor, so that the supply of a d-c power to said switching elements when said battery voltage lowers below a predetermined voltage level.

22. A system for controlling the operation of a vibrating compressor set forth in claim 15 wherein said control section comprises a d-c power relay for feeding a d-c power, a battery monitor for generating a battery monitor signal when a battery voltage applied to said control section as a d-c power lowers below a predetermined voltage level so as to control said d-c power relay and interrupt the supply of a d-c power to said switching elements.

23. A system for controlling the operation of a vibrating compressor set forth in claim 15 wherein said control section comprises alternately operating switching elements, a drive circuit for operating said switching elements at a predetermined frequency; and a transformer for generating an alternating current voltage by the alternate operation of said switching elements and a surge voltage suppression element are provided at points connecting said alternately operating switching elements and each winding of said transformer so as to suppress surge voltages caused by electromagnetic induction in said transformer along with the operation of said switching elements.

* * * * *